US011846140B2

(12) United States Patent
Rong et al.

(10) Patent No.: US 11,846,140 B2
(45) Date of Patent: Dec. 19, 2023

(54) AUTONOMOUS FLOW CONTROL DEVICES FOR VISCOSITY DOMINANT FLOW

(71) Applicant: Floway Innovations Inc., Plano, TX (US)

(72) Inventors: Xinqi Rong, Dallas, TX (US); Liang Zhao, Allen, TX (US)

(73) Assignee: Floway Innovations Inc., Plano, TX (US)

( * ) Notice: Subject to any disclaimer, the term of this patent is extended or adjusted under 35 U.S.C. 154(b) by 0 days.

(21) Appl. No.: 17/982,795

(22) Filed: Nov. 8, 2022

(65) Prior Publication Data

US 2023/0193723 A1 Jun. 22, 2023

Related U.S. Application Data

(60) Provisional application No. 63/290,419, filed on Dec. 16, 2021.

(51) Int. Cl.
*E21B 34/08* (2006.01)
*E21B 43/08* (2006.01)

(52) U.S. Cl.
CPC ..... *E21B 34/08* (2013.01); *E21B 43/086* (2013.01); *E21B 2200/02* (2020.05)

(58) Field of Classification Search
CPC ..... E21B 34/08; E21B 43/12
See application file for complete search history.

(56) References Cited

U.S. PATENT DOCUMENTS 8,191,627 B2 6/2012 Hamid et al.
8,291,976 B2 10/2012 Schultz et al.
8,602,106 B2 12/2013 Lopez
8,622,136 B2 1/2014 Dykstra et al.
8,931,566 B2 1/2015 Dykstra et al.
9,109,423 B2 8/2015 Dykstra et al.
9,249,649 B2 2/2016 Fripp et al.
9,394,759 B2 7/2016 Fripp et al.
(Continued)

FOREIGN PATENT DOCUMENTS

EP 2620587 A2 * 7/2013 ..... E21B 43/12

OTHER PUBLICATIONS

Miersma, Matthew; Analysis of Inflow Control Devices for Steam Assisted Gravity Drainage Using Computational Fluid Dynamics; Department of Mechanical Engineering—University of Alberta; 2018.

*Primary Examiner* — Matthew R Buck
(74) *Attorney, Agent, or Firm* — Lawrence Youst PLLC

(57) ABSTRACT

An autonomous flow control device includes a valve assembly having a fluid inlet and a fluid outlet. A valve element is disposed between the fluid inlet and the fluid outlet. The valve element has a viscosity dominant flow path configured to provide a first flow resistance and an inertia dominant flow path configured to provide a second flow resistance that is greater than the first flow resistance such that when the viscosity of the fluid flowing therethrough is greater than a first predetermined level, the fluid follows the viscosity dominant flow path with the first flow resistance and when the viscosity of the fluid flowing therethrough is less than a second predetermined level, the fluid follows the inertia dominant flow path with the second flow resistance, thereby regulating the production rate of the fluid responsive to changes in the viscosity of the fluid.

18 Claims, 16 Drawing Sheets

(56) References Cited

U.S. PATENT DOCUMENTS

| | | | | |
|---|---|---|---|---|
| 9,404,349 | B2 | 8/2016 | Zhao | |
| 10,060,221 | B1 | 8/2018 | Rong et al. | |
| 10,174,588 | B1 | 1/2019 | Rong et al. | |
| 10,364,646 | B2 | 7/2019 | Rong et al. | |
| 10,711,569 | B2 | 7/2020 | Rong et al. | |
| 11,428,072 | B2 | 8/2022 | Rong et al. | |
| 2009/0145609 | A1 | 6/2009 | Holmes et al. | |
| 2011/0139453 | A1 | 6/2011 | Schultz et al. | |
| 2012/0152527 | A1 | 6/2012 | Dykstra et al. | |
| 2012/0255740 | A1 | 10/2012 | Fripp et al. | |
| 2013/0092393 | A1 | 4/2013 | Dykstra et al. | |
| 2013/0161018 | A1* | 6/2013 | Fripp | E21B 34/06 166/319 |
| 2015/0021019 | A1 | 1/2015 | Veit | |
| 2015/0060084 | A1 | 3/2015 | Moen et al. | |
| 2016/0061373 | A1 | 3/2016 | Russell et al. | |
| 2017/0044868 | A1* | 2/2017 | van Petegem | E21B 34/08 |
| 2019/0345793 | A1 | 11/2019 | Rong et al. | |
| 2020/0308931 | A1* | 10/2020 | Rong | E21B 43/08 |

* cited by examiner

AUTONOMOUS FLOW CONTROL DEVICES FOR VISCOSITY DOMINANT FLOW

CROSS-REFERENCE TO RELATED APPLICATIONS

The present application claims the benefit of U.S. Provisional Application No. 63/290,419, filed Dec. 16, 2021, the entire contents of which is hereby incorporated by reference.

TECHNICAL FIELD OF THE DISCLOSURE

The present disclosure relates, in general, to equipment used in conjunction with operations performed in hydrocarbon bearing subterranean wells and, in particular, to autonomous flow control devices having a lower resistance to viscosity dominant fluid flow than to inertia dominant fluid flow.

BACKGROUND

During the completion of a well that traverses a hydrocarbon bearing subterranean formation, production tubing and various completion equipment are installed in the well to enable safe and efficient production of the formation fluids. In some wells, to control the flowrate of production fluids into the production tubing, a fluid flow control system is installed within the tubing string that may include one or more inflow control devices. Typically, the production flowrate through these inflow control devices is fixed prior to installation. It has been found, however, that production fluids are commonly multiphase fluids including oil, natural gas, water and/or other fractional components. In addition, it has been found, that the proportions of the various fluid components may change over time. For example, in an oil-producing well, the proportion of an undesired fluid such as natural gas or water may increase as the well matures.

As the proportions of the fluid components change, various properties of the production fluid may also change. For example, when the production fluid has a high proportion of oil relative to natural gas or water, the viscosity of the production fluid is higher than when the production fluid has a high proportion of natural gas or water relative to oil. Attempts have been made to reduce or prevent the production of undesired fluids in favor of desired fluids through the use of autonomous inflow control devices that interventionlessly respond to changing fluid properties downhole. Certain autonomous inflow control devices include one or more valve elements that are fully open responsive to the flow of a desired fluid, such as oil, but restrict production responsive to the flow of an undesired fluid, such as natural gas or water. It has been found, however, that systems incorporating current autonomous inflow control technology suffer from a variety of limitations such as fatigue failure of biasing devices, failure of intricate components or complex structures and/or lack of sensitivity.

Accordingly, a need has arisen for a downhole fluid flow control system that is operable to control the inflow of production fluid as the proportions of the fluid components change over time without the requirement for well intervention. A need has also arisen for such a downhole fluid flow control system that does not require the use of biasing devices, intricate components or complex structures.

SUMMARY

In a first aspect, the present disclosure is directed to an autonomous flow control device for regulating a production rate of a fluid having a viscosity. The autonomous flow control device includes a valve assembly having at least one fluid inlet and at least one fluid outlet. A valve element is disposed between the at least one fluid inlet and the at least one fluid outlet. The valve element has a viscosity dominant flow path configured to provide a first flow resistance and an inertia dominant flow path configured to provide a second flow resistance that is greater than the first flow resistance. When the viscosity of the fluid flowing therethrough is greater than a first predetermined level, the fluid follows the viscosity dominant flow path with the first flow resistance. When the viscosity of the fluid flowing therethrough is less than a second predetermined level, the fluid follows the inertia dominant flow path with the second flow resistance, thereby regulating the production rate of the fluid responsive to changes in the viscosity of the fluid.

In certain embodiments, when the fluid is oil, the fluid follows the viscosity dominant flow path with the first flow resistance. In some embodiments, when the fluid is water, the fluid follows the inertia dominant flow path with the second flow resistance. In certain embodiments, when the fluid is natural gas, the fluid follows the inertia dominant flow path with the second flow resistance. In some embodiments, when the fluid is a multiphase fluid containing an oil component and a water component, the fluid follows the viscosity dominant flow path with the first flow resistance if the fluid has at least a predetermined portion of the oil component and the fluid follows the inertia dominant flow path with the second flow resistance if the fluid has at least a predetermined portion of the water component. In certain embodiments, when the fluid is a multiphase fluid containing an oil component and a natural gas component, the fluid follows the viscosity dominant flow path with the first flow resistance if the fluid has at least a predetermined portion of the oil component and the fluid follows the inertia dominant flow path with the second flow resistance if the fluid has at least a predetermined portion of the natural gas component.

In some embodiments, when the fluid is a multiphase fluid, the valve element is configured to interpret the viscosity of the fluid as an effective viscosity of a single phase fluid. In certain embodiments, the first predetermined level of the viscosity may be between 1 centipoise and 10 centipoises and the second predetermined level of the viscosity may be between 0.1 centipoises and 1 centipoise. In some embodiments, the first predetermined level of the viscosity may have a ratio to the second predetermined level of the viscosity of between 2 to 1 and 10 to 1. In certain embodiments, the valve element may be a multistage valve element such as a multistage self-impinging valve element, a multistage sinuous valve element, a multistage waveform valve element or a multistage valve element with each stage including parallel paths. In some embodiments, the viscosity dominant flow path may be a higher flowrate path than the inertia dominant flow path. In certain embodiments, the viscosity dominant flow path may have a larger effective flow area than the inertia dominant flow path.

In a second aspect, the present disclosure is directed to a flow control screen for regulating a production rate of a fluid having a viscosity. The flow control screen includes a base pipe with an internal passageway and at least one base pipe inlet, a filter medium positioned around the base pipe and at least one autonomous flow control device coupled to the base pipe. Each autonomous flow control device includes a valve assembly having at least one fluid inlet and at least one fluid outlet such that the at least one fluid outlet is in fluid communication with the at least one base pipe inlet. A valve element is disposed between the at least one fluid inlet and the at least one fluid outlet. The valve element has a viscosity dominant flow path configured to provide a first flow resistance and an inertia dominant flow path configured to provide a second flow resistance that is greater than the first flow resistance. When the viscosity of the fluid flowing therethrough is greater than a first predetermined level, the fluid follows the viscosity dominant flow path with the first flow resistance. When the viscosity of the fluid flowing therethrough is less than a second predetermined level, the fluid follows the inertia dominant flow path with the second flow resistance, thereby regulating the production rate of the fluid responsive to changes in the viscosity of the fluid.

In a third aspect, the present disclosure is directed to a completion string for regulating a production rate of a fluid having a viscosity. The completion string includes a plurality of flow control screens each having a base pipe with an internal passageway and at least one base pipe inlet, a filter medium positioned around the base pipe and at least one autonomous flow control device coupled to the base pipe. Each autonomous flow control device includes a valve assembly having at least one fluid inlet and at least one fluid outlet with the at least one fluid outlet in fluid communication with the respective base pipe inlet. A valve element is disposed between the at least one fluid inlet and the at least one fluid outlet. The valve element has a viscosity dominant flow path configured to provide a first flow resistance and an inertia dominant flow path configured to provide a second flow resistance that is greater than the first flow resistance. When the viscosity of the fluid flowing therethrough is greater than a first predetermined level, the fluid follows the viscosity dominant flow path with the first flow resistance. When the viscosity of the fluid flowing therethrough is less than a second predetermined level, the fluid follows the inertia dominant flow path with the second flow resistance, thereby regulating the production rate of the fluid responsive to changes in the viscosity of the fluid.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

While the making and using of various embodiments of the present disclosure are discussed in detail below, it should be appreciated that the present disclosure provides many applicable inventive concepts, which can be embodied in a wide variety of specific contexts. The specific embodiments discussed herein are merely illustrative and do not delimit the scope of the present disclosure. In the interest of clarity, not all features of an actual implementation may be described in the present disclosure. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would be a routine undertaking for those having ordinary skill in the art with the benefit of this disclosure.

In the specification, reference may be made to the spatial relationships between various components and to the spatial orientation of various aspects of components as depicted in the attached drawings. It will be recognized, however, by those having ordinary skill in the art after a complete reading of the present disclosure, that the devices, members, systems, elements, apparatuses, chambers, pathways and other like components described herein may be positioned in any desired orientation. Thus, the use of terms such as "above," "below," "upper," "lower" or other like terms to describe spatial relationships should be understood to describe relative spatial relationships, as the components described herein may be oriented in any desired direction. As used herein, the term "coupled" may include direct or indirect coupling by any means, including moving and/or non-moving mechanical connections.

Figure 1:
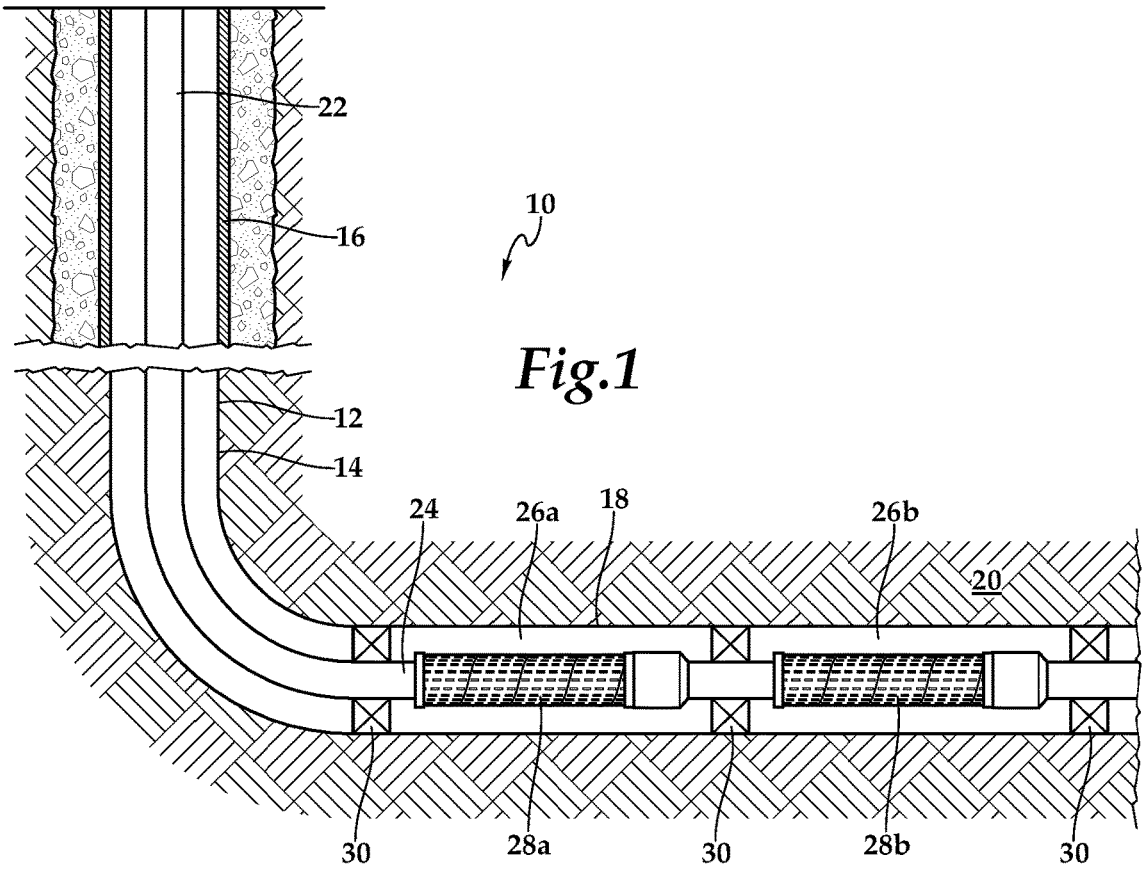
FIG. 1 is a schematic illustration of a well system operating a completion string including a plurality of flow control screens each having one or more autonomous flow control devices according to embodiments of the present disclosure.

Referring initially to FIG. 1, therein is depicted a well system including a completion string with a plurality of autonomous flow control devices positioned in flow control screens embodying principles of the present disclosure that is schematically illustrated and generally designated 10. In the illustrated embodiment, a wellbore 12 extends through the various earth strata. Wellbore 12 has a substantially vertical section 14, the upper portion of which includes a casing string 16 that has been cemented therein. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22 that provides a conduit for formation fluids to travel from formation 20 to the surface and/or for injection fluids to travel from the surface to formation 20. At its lower end, tubing string 22 is coupled to a completion string 24 that has been installed in wellbore 12 and divides the completion interval into various production intervals such as production intervals 26*a*, 26*b* that are adjacent to formation 20. Completion string 24 includes a plurality of flow control screens 28*a*, 28*b*, each of which is positioned between a pair of annular barriers depicted as packers 30 that provide a fluid seal between completion string 24 and wellbore 12, thereby defining production intervals 26*a*, 26*b*. In the illustrated embodiment, flow control screens 28*a*, 28*b* serve the functions of filtering particulate matter out of the production fluid stream as well as providing autonomous flow control as the proportions of the various fluid components in the production fluid change over time utilizing the autonomous flow control devices of the present disclosure.

For example, the flow control sections of flow control screens 28*a*, 28*b* may be operable to control the inflow of a production fluid stream during the production phase of well operations. Alternatively or additionally, the flow control sections of flow control screens 28*a*, 28*b* may be operable to control the flow of an injection fluid stream during a treatment phase of well operations. As explained in greater detail herein, the flow control sections preferably control the inflow of production fluids from each production interval without the requirement for well intervention as the composition or fluid proportions of the production fluid entering specific intervals changes over time in order to maximize production of a selected fluid and minimize production of a non-selected fluid. For example, the present flow control screens may be tuned to maximize the production of oil and minimize the production of water. As another example, the present flow control screens may be tuned to maximize the production of oil and minimize the production of natural gas. In yet another example, the present flow control screens may be tuned to maximize the production of natural gas and minimize the production of water.

Even though FIG. 1 depicts the flow control screens of the present disclosure in an open hole environment, it should be understood by those having ordinary skill in the art that the present flow control screens are equally well suited for use in cased wells. Also, even though FIG. 1 depicts one flow control screen in each production interval, it should be understood by those having ordinary skill in the art that any number of flow control screens may be deployed within a production interval without departing from the principles of the present disclosure. In addition, even though FIG. 1 depicts the flow control screens in a horizontal section of the wellbore, it should be understood by those having ordinary skill in the art that the present flow control screens are equally well suited for use in wells having other directional configurations including vertical wells, deviated wells, slanted wells, multilateral wells and the like. Further, even though the flow control systems in FIG. 1 have been described as being associated with flow control screens in a tubular string, it should be understood by those having ordinary skill in the art that the flow control systems of the present disclosure need not be associated with a screen or be deployed as part of the tubular string. For example, one or more flow control systems may be deployed and removably inserted into the center of the tubing string or inside pockets of the tubing string.

Figure 2:
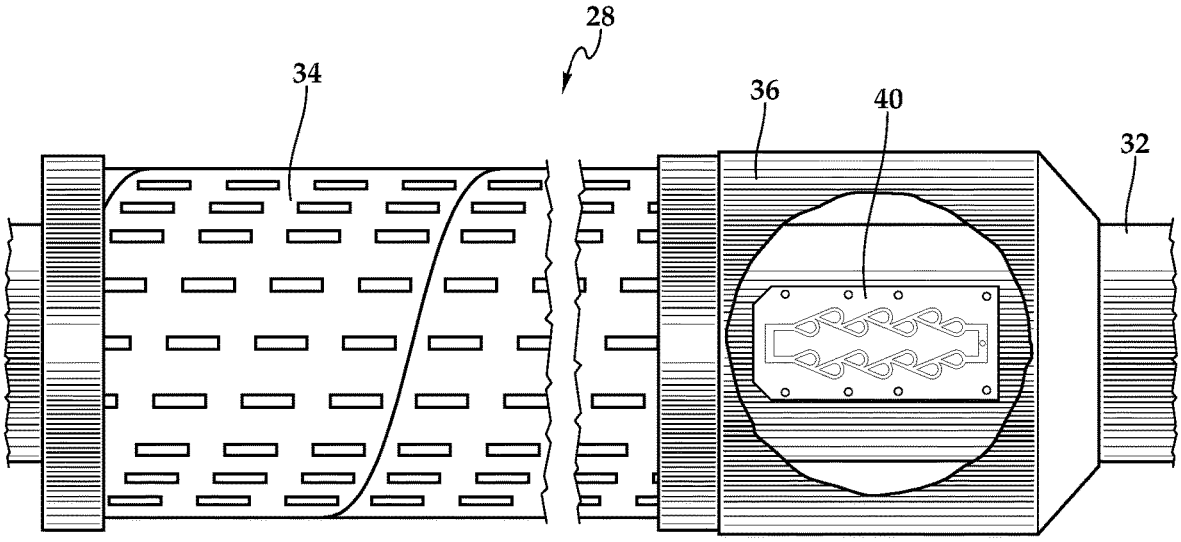
FIG. 2 is a top view of a flow control screen including an autonomous flow control device according to embodiments of the present disclosure.

Referring next to FIG. 2, therein is depicted a flow control screen according to the present disclosure that is representatively illustrated and generally designated 28. Flow control screen 28 may be suitably coupled to other similar flow control screens, production packers, locating nipples, production tubulars or other downhole tools to form a completions string as described above. Flow control screen 28 includes a base pipe 32 that preferably has a blank pipe section disposed to the interior of a screen element or filter medium 34, such as a wire wrap screen, a woven wire mesh screen, a prepacked screen or the like, with or without an outer shroud positioned therearound, designed to allow fluids to flow therethrough but prevent particulate matter of a predetermined size from flowing therethrough. It will be understood, however, by those having ordinary skill in the art that the embodiments of the present disclosure do not require a filter medium, accordingly, the exact design of the filter medium is not critical to the present disclosure.

Fluid produced through filter medium 34 travels toward and enters an annular area between outer housing 36 and base pipe 32. To enter the interior of base pipe 32, the fluid must pass through an autonomous flow control device 40 and a perforated section of base pipe 32 that is disposed under autonomous flow control device 40. In the illustrated embodiment, autonomous flow control device 40 is seen through a cutaway section of outer housing 36 and with an upper plate of autonomous flow control device 40 removed. The flow control system of each flow control screen 28 may include one or more autonomous flow control devices 40. In certain embodiments, autonomous flow control devices 40 may be circumferentially distributed about base pipe 32 such as at 180 degree intervals, 120 degree intervals, 90 degree intervals or other suitable distribution. Alternatively or additionally, autonomous flow control devices 40 may be longitudinally distributed along base pipe 32. Regardless of the exact configuration of autonomous flow control devices 40 on base pipe 32, any desired number of autonomous flow control devices 40 may be incorporated into a flow control screen 28, with the exact configuration depending upon factors that are known to those having ordinary skill in the art including the reservoir pressure, the expected composition of the production fluid, the desired production rate and the like. The various connections between the components of flow control screen 32 may be made in any suitable fashion including welding, threading and the like as well as through the use of fasteners such as pins, set screws and the like. Even though autonomous flow control device 40 has been described and depicted as being coupled to the exterior of base pipe 32, it will be understood by those having ordinary skill in the art that the autonomous flow control devices of the present disclosure may be alternatively positioned such as within openings of the base pipe or to the interior of the base pipe so long as the autonomous flow control devices are positioned between the upstream or formation side and the downstream or base pipe interior side of the formation fluid path.

Autonomous flow control devices 40 may be operable to control the flow of fluid in both the production direction and the injection direction therethrough. For example, during the production phase of well operations, fluid flows from the formation into the production tubing through fluid flow control screen 28. The production fluid, after being filtered by filter medium 34, if present, flows into the annulus between base pipe 32 and outer housing 36. The fluid then enters autonomous flow control device 40 where the desired flow operation occurs depending upon the viscosity or other interpreted fluid property of the produced fluid. For example, if a selected fluid such as oil is being produced, the flow through autonomous flow control device 40 follows a low resistance flow path enabling a high flowrate. If a non-selected fluid such as water is being produced, the flow through autonomous flow control device 40 follows a high resistance flow path creating a low flowrate.

Figure 3:
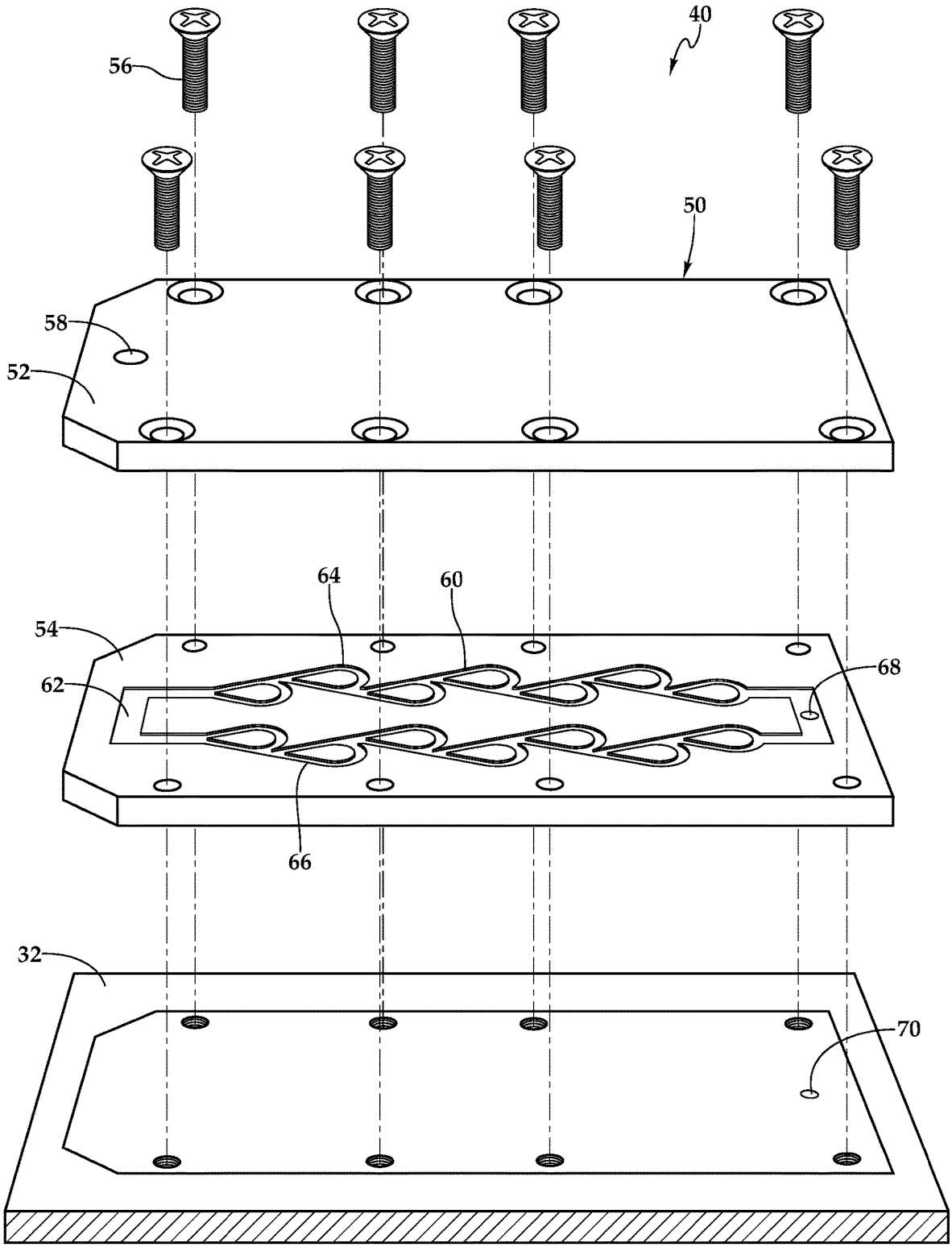
FIG. 3 is an exploded view of an autonomous flow control device according to embodiments of the present disclosure.

Referring next to FIG. 3, an autonomous flow control device for use in a downhole fluid flow control system of the present disclosure is representatively illustrated and generally designated 40. In the illustrated embodiment, autonomous flow control device 40 includes a valve assembly 50 that is formed by coupling an outer plate 52 and an inner plate 54 to base pipe 32 with a plurality of fasteners depicted as screws 56. As illustrated, outer plate 52, inner plate 54 and base pipe 32 have matching hole patterns that enable screws 56 to pass through outer plate 52 and inner plate 54 and to threadedly couple with base pipe 32 to form valve assembly 50. Outer plate 52 and inner plate 54 may be metal plates formed from a stainless steel, a titanium alloy, a nickel alloy, a tungsten carbide or other suitable corrosion resistant material.

Autonomous flow control device 40 has an inlet 58 that extends through outer plate 52. Autonomous flow control device 40 also includes a valve element 60 which can be seen on an upper surface of inner plate 54. Alternatively, valve element 60 could be on the lower surface of outer plate 52. As another alternative, the upper surface of inner plate 54 and the lower surface of outer plate 52 could each include a portion of valve element 60 such that these features are fully formed when outer plate 52 and inner plate 54 are mated together to form valve assembly 50 and/or coupled to base pipe 32. Valve element 60 may be formed on inner plate 54 and/or outer plate 52 by a material removal process such as machining, etching or the like or by an additive manufacturing process such as deposition, 3D printing, laser melting or the like.

Figure 4A:
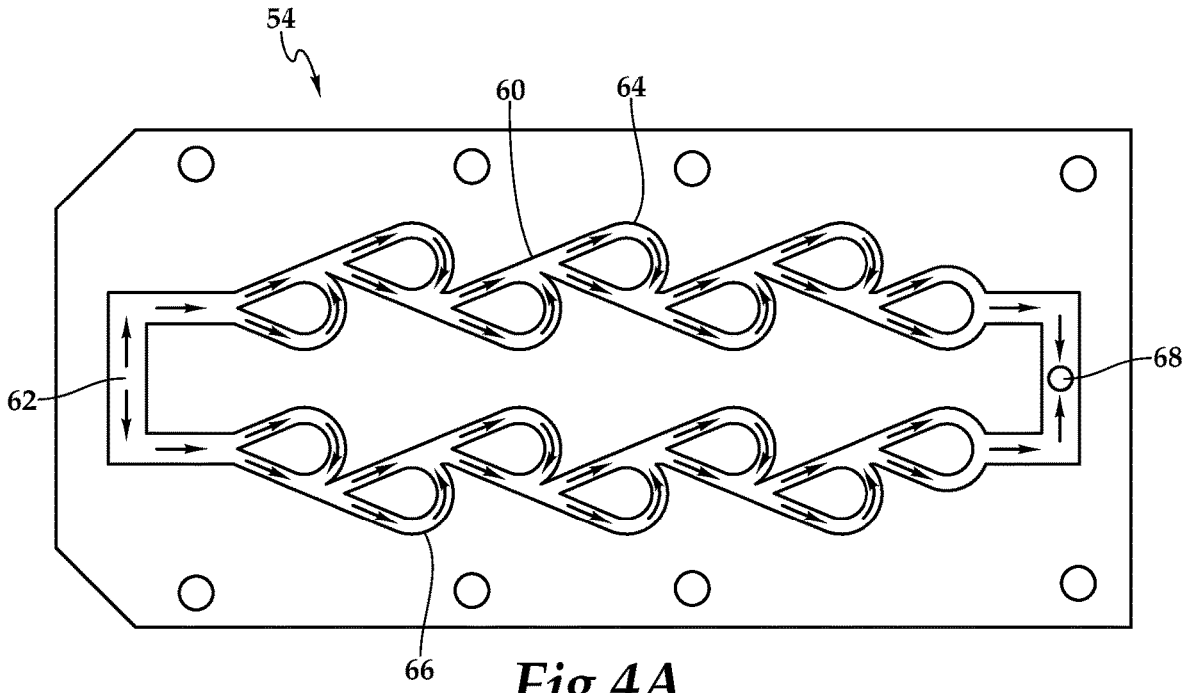
FIGS. 4A-4B are schematic illustrations of a valve element of an autonomous flow control device according to embodiments of the present disclosure.
Figure 4B:
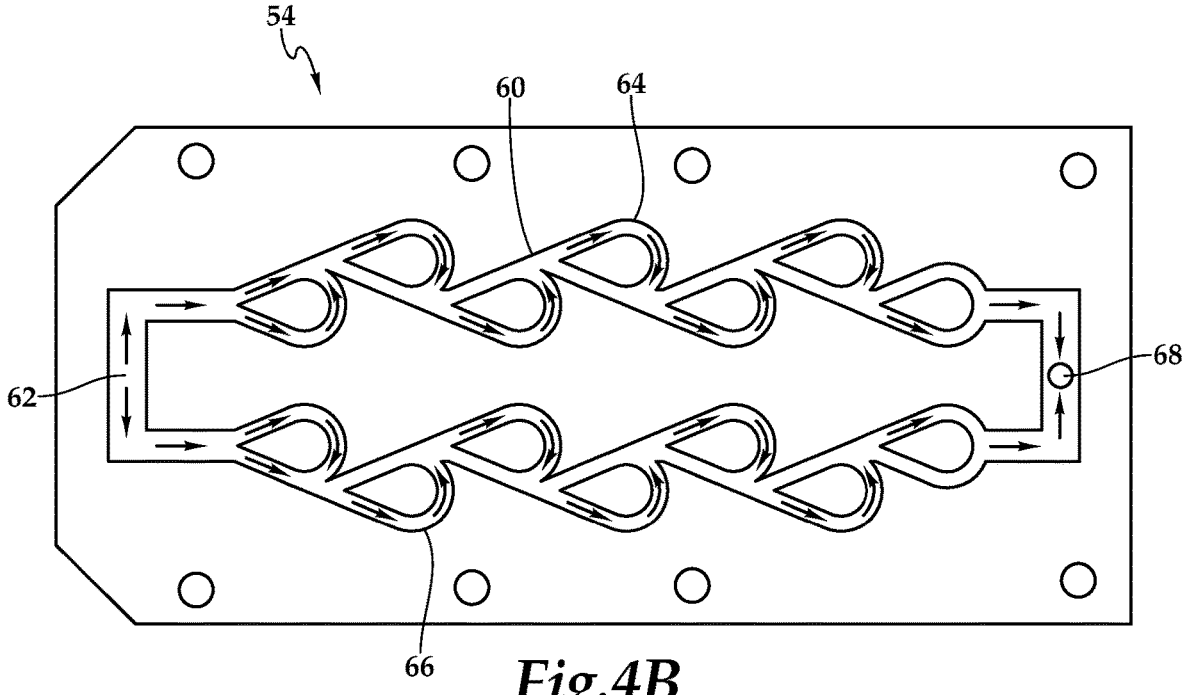

Referring additionally to FIGS. 4A-4B, top views of inner plate 54 including valve element 60 are depicted. In the illustrated embodiment, valve element 60 is configured to interpret the viscosity of a fluid flowing therethrough to determine whether the fluid is a selected fluid, such oil, or a non-selected fluid, such as natural gas or water. Specifically, valve element 60 includes a viscosity dominant flow path depicted in FIG. 4A and an inertia dominant flow path depicted in FIG. 4B. In the illustrated embodiment, the viscosity dominant flow path provides a first resistance to flow therethrough and the inertia dominant flow path having a second resistance to flow therethrough that is greater than the first resistance as valve element 60 tends to create an increasing resistance to flow with increasing fluid momentum. As an example, when the fluid flowing through valve element 60 has a viscosity greater than a first predetermined level, such as a viscosity between 1 and 10 centipoises, the fluid follows the viscosity dominant flow path (see FIG. 4A). Conversely, when the fluid flowing through valve element 60 has a viscosity less than a second predetermined level, such as viscosity between 0.1 and 1 centipoise, the fluid follows the inertia dominant flow path (see FIG. 4B). In this example, when the fluid flowing through valve element 60 is the selected fluid of oil, which has a viscosity greater than the first predetermined level, the selected fluid encounters relatively low resistance described herein as the first resistance. When the fluid flowing through valve element 60 is a non-selected fluid of water or natural gas, which have a viscosity less than the second predetermined level, the non-selected fluid encounters relatively high resistance described herein as the second resistance. In this manner, valve element 60 interprets the viscosity of the fluid flowing therethrough and determines whether the fluid is a selected fluid, such as oil, or a non-selected fluid, such as natural gas or water, and imposes the desired resistance to flow.

The first and second predetermined levels of valve element 60 may be tuned based upon the specific implementations of valve element 60. If it is desired to discriminate between fluids having similar viscosities, such as light crude oil and water, the ratio between the first predetermined level and the second predetermined level may be about 2 to 1 or less. To discriminate between fluids having less similar viscosities, such as medium or heavy crude oil and water, the ratio between the first predetermined level and the second predetermined level may be about 10 to 1 or greater. It is noted that production fluids are commonly multiphase fluids including oil, natural gas, water and/or other fractional components. When the fluid flowing through valve element 60 is a multiphase fluid, valve element 60 interprets the viscosity of the fluid as an effective viscosity of a single phase fluid. In this manner, when the proportions and thus the viscosity of the production fluid changes over time, valve element 60 determines whether the fluid is a selected fluid, one with a viscosity greater than the first predetermined level, or a non-selected fluid, one with a viscosity less than the second predetermined level. Thus, as the ratio of the water portion to the oil portion in a production fluid increases, valve element 60 is configured to transition the production fluid from being a selected fluid to being a non-selected fluid.

In the illustrated embodiment, valve element 60 is a multistage self-impinging valve element having parallel branches. Valve element 60 includes a common inlet 62 that is aligned with and in fluid communication with inlet 58 of outer plate 52 when valve assembly 50 is fully assembled. Inlet 62 feeds the two parallel branches 64, 66 of valve element 60. Branches 64, 66 feed a common outlet 68 that is aligned with and in fluid communication with a base pipe inlet 70 of base pipe 32 when valve assembly 50 is fully assembled. Even though branches 64, 66 of valve element 60 have been depicted and described as sharing a common inlet 62, it should be understood by those having ordinary skill in the art that multiple branches of a valve element of the present disclosure could have separate inlets. Also, even though branches 64, 66 of valve element 60 have been depicted and described as sharing a common outlet 68, it should be understood by those having ordinary skill in the art that multiple branches of a valve element of the present disclosure could feed separate outlets. In addition, even though valve element 60 has been depicted and described as having two parallel branches 64, 66, it should be understood by those having ordinary skill in the art that a valve element of the present disclosure could have other numbers of branches both greater than or less than two including a single branch. It should be noted that the use of the term parallel branches does not require that the branches are physically parallel to each other but rather that their terminals are connected to common pressure nodes.

The operation of valve element 60 will now be described with four different fluids flowing therethrough and with the aid of FIGS. 5A-5D which depict a foreshorten version of branch 66 for clarity. It is noted that branch 66 is substantially similar to branch 64 therefore, for sake of efficiency, certain features will be disclosed only with regard to branch 66. One having ordinary skill in the art, however, will fully appreciate an understanding of branch 64 based upon the disclosure herein of branch 66. For the present example, valve element 60 has been tuned such that the first predetermined level is about 10 centipoises and the second predetermined level is about 1 centipoise.

Figure 5A:
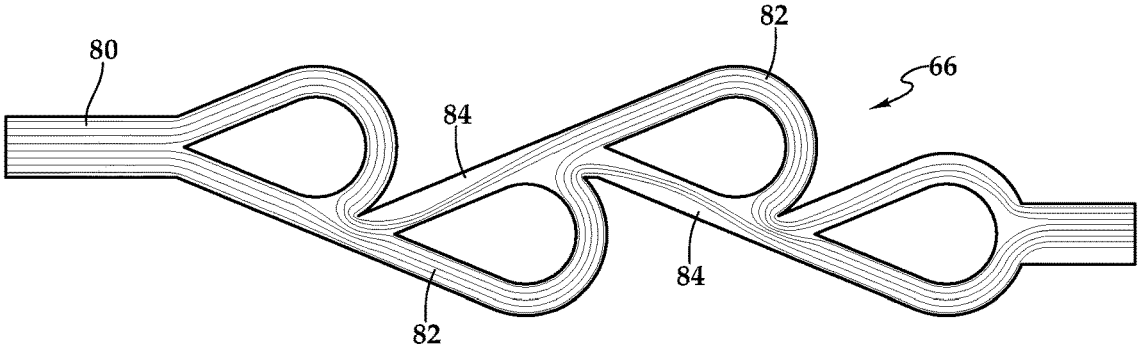
FIGS. 5A-5D are schematic illustrations of a valve element of an autonomous flow control device according to embodiments of the present disclosure.

When the fluid flowing through valve element 60 has a viscosity greater than the first predetermined level, the fluid follows the viscosity dominant flow path depicted in FIG. 4A and as indicated by the flow arrows present in both the compliant flow paths and the impinging flow paths within the tesla valve conduits of branches 64, 66. For example, as best seen in FIG. 5A, branch 66 provides a viscosity dominant flow path when the fluid flowing therethrough has a viscosity greater than the first predetermined level such as a selected fluid in the form of oil having a viscosity in the range of 50 centipoises flowing from left to right as indicated by streamlines 80. In the illustrated embodiment, after the first tesla loop, approximately sixty percent of the fluid flows in impinging flow paths 82 with approximately forty percent of the fluid flowing in compliant flow paths 84. Thus, in the case of medium oil flowing through valve element 60, nearly the entire cross section of the tesla valve conduit is utilized along the entire length of branch 66 allowing the fluid to flow at a relative high flowrate. As illustrated, the viscosity dominant flow path provides a low resistance flow path that minimizes losses. In this manner, production of the selected fluid, in the case medium oil, is maximized.

Figure 5B:
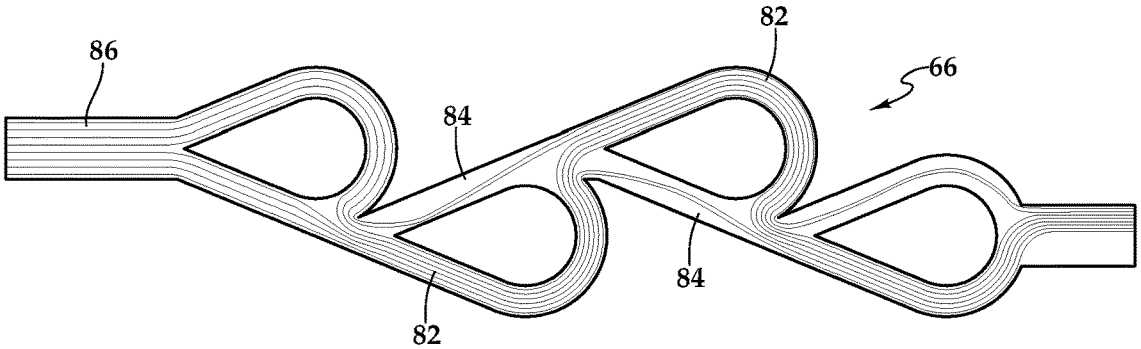

As another example, FIG. 5B depicts a selected fluid in the form of oil having a viscosity in the range of 10 centipoises flowing from left to right as indicated by streamlines 86. In the illustrated embodiment, after the first tesla loop, approximately seventy-five percent of the fluid flows in impinging flow paths 82 with approximately twenty-five percent of the fluid flowing in compliant flow paths 84. Thus, in the case of light oil flowing through valve element 60, a majority of the cross section of the tesla valve conduit is utilized along the entire length of branch 66 allowing the fluid to flow at a relative high flowrate. As illustrated, the viscosity dominant flow path provides a low resistance flow path that minimizes losses. In this manner, production of the selected fluid, in the case light oil, is maximized.

Figure 5C:
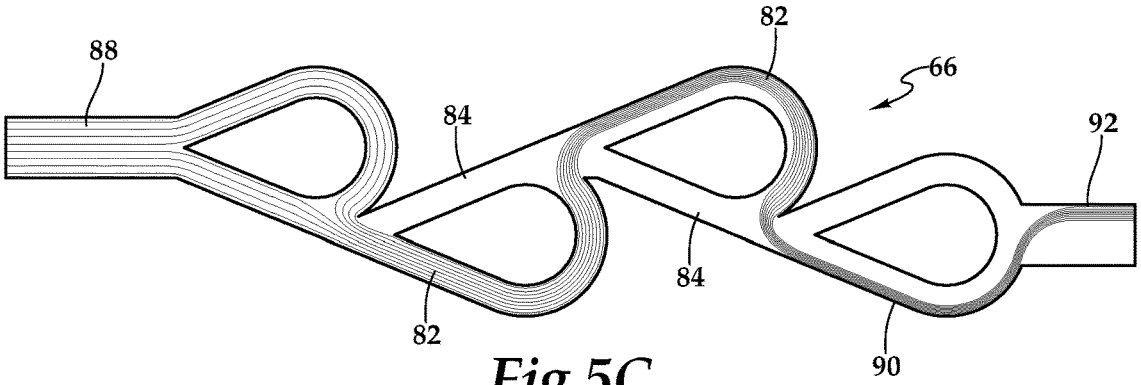

When the fluid flowing through valve element 60 has a viscosity less than the second predetermined level, the fluid follows the inertia dominant flow path depicted in FIG. 4B and as indicated by the flow arrows present only in the impinging flow paths within the tesla valve conduits of branches 64, 66. For example, as best seen in FIG. 5C, branch 66 provides an inertia dominant flow path when the fluid flowing therethrough has a viscosity less than the second predetermined level, such as a non-selected fluid in the form of water having a viscosity in the range of 0.50 centipoises flowing from left to right as indicated by streamlines 88. In the illustrated embodiment, after the first tesla loop, all or nearly all of the fluid flows in impinging flow paths 82 with little to no fluid flowing in compliant flow paths 84. Thus, in the case of water flowing through valve element 60, significant portions of the cross section of the tesla valve conduit are not utilized. This flow interference or choking is further exemplified toward the end of branch 66 in the last tesla loop at location 90 and the discharge tube at location 92 in which the fluid uses only a fraction of the available cross section of the tesla valve conduit, thereby resulting in a significantly reduced flowrate. As illustrated, the inertia dominant flow path provides a turbulent and self-impinging path around outside channels of the conduit creating large losses. In this manner, production of the non-selected fluid, in this case water, is minimized.

Figure 5D:
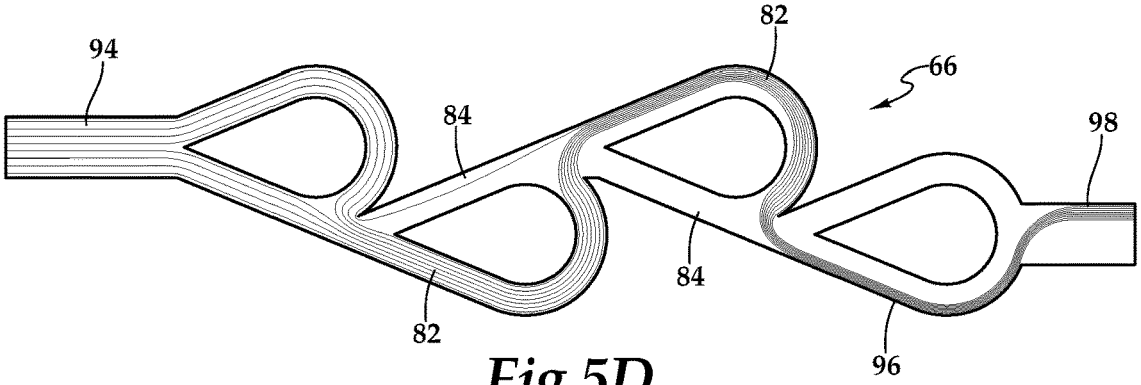

As another example, FIG. 5D depicts a non-selected fluid in the form of natural gas having a viscosity in the range of 0.02 centipoises flowing from left to right as indicated by streamlines 94. In the illustrated embodiment, after the first tesla loop, all or nearly all of the fluid flows in impinging flow paths 82 with little to no fluid flowing in compliant flow paths 84. Thus, in the case of natural gas flowing through valve element 60, significant portions of the cross section of the tesla valve conduit are not utilized. This flow interference or choking is further exemplified toward the end of branch 66 in the last tesla loop at location 96 and the discharge tube at location 98 in which the fluid uses only a fraction of the available cross section of the tesla valve conduit, thereby resulting in a significantly reduced flowrate. As illustrated, the inertia dominant flow path provides a turbulent and self-impinging path around outside channels of the conduit creating large losses. In this manner, production of the non-selected fluid, in this case natural gas, is minimized. As illustrated, based upon the design of branches 64, 66, valve element 60 is configured to interpret the viscosity of a fluid flowing therethrough and to determine whether the fluid is a selected fluid, such as oil, or a non-selected fluid, such as natural gas or water.

Figure 6A:
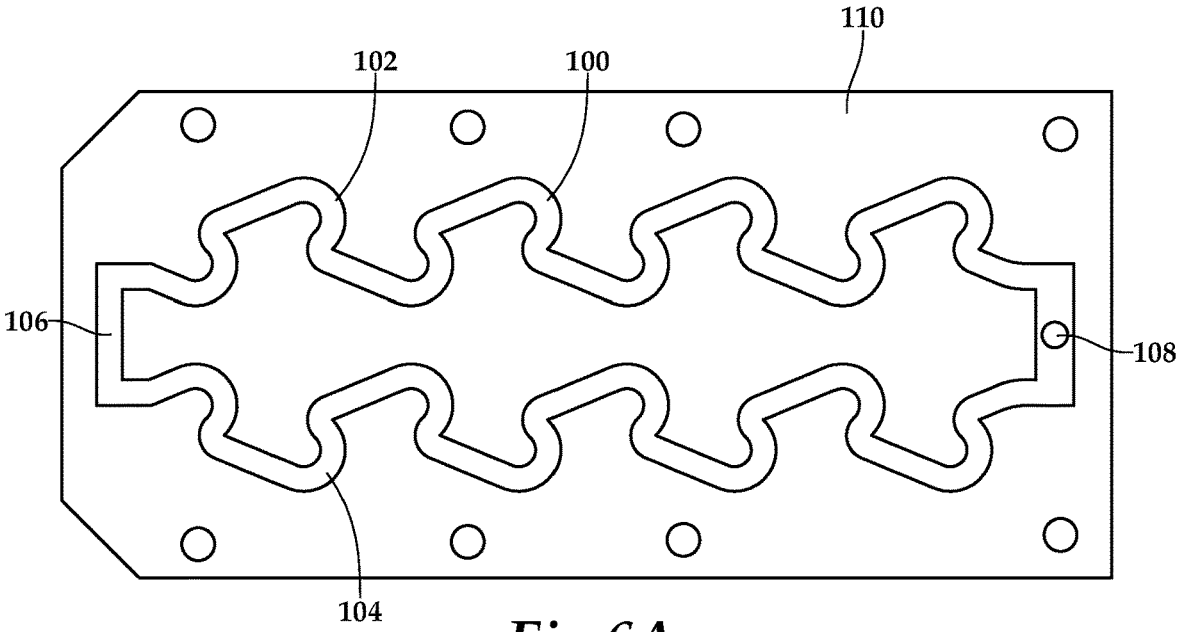
FIGS. 6A-6C are schematic illustrations of a valve element of an autonomous flow control device according to embodiments of the present disclosure.
Figure 6B:
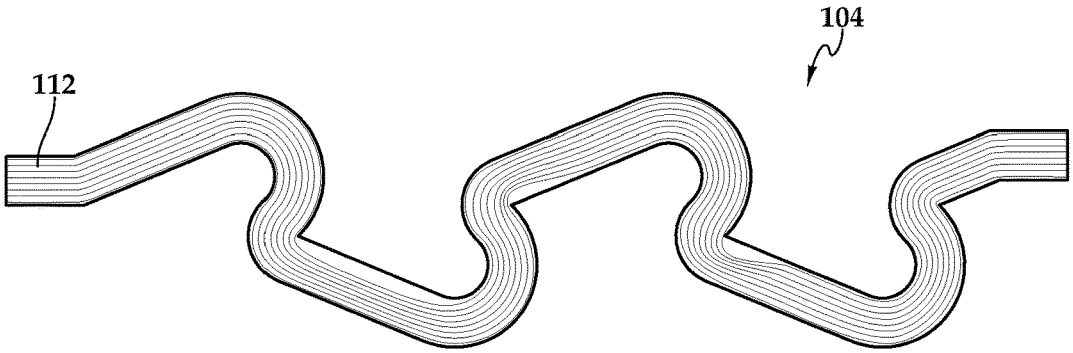
Figure 6C:
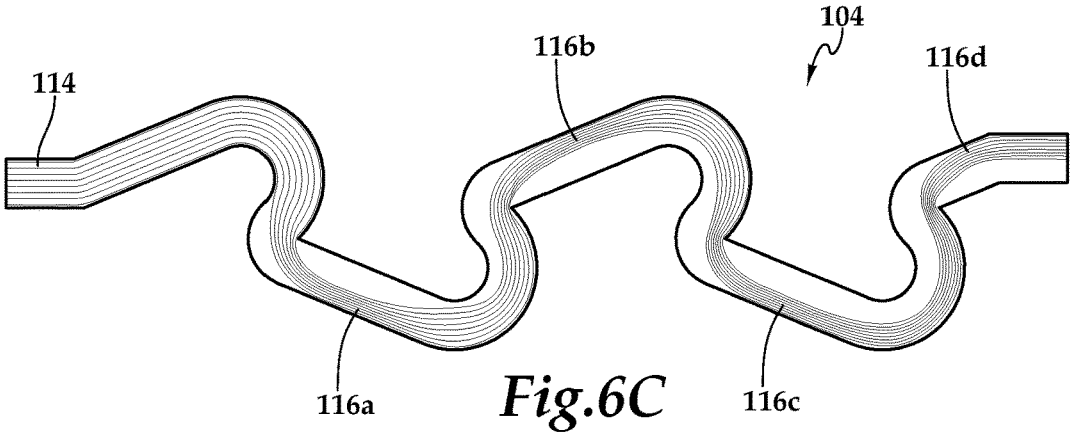

Even though valve element 60 has been depicted and described as having a self-impinging tesla conduit with fluid selection functionality, it should be understood by those having ordinary skill in the art that a valve element for an autonomous flow control device of the present disclosure could use other types of conduits with fluid selection functionality. For example, FIGS. 6A-6C depict a valve element 100 that is configured to interpret the viscosity of a fluid flowing therethrough to determine whether the fluid is a selected fluid, such oil, or a non-selected fluid, such as natural gas or water. Specifically, valve element 100 includes a viscosity dominant flow path having a first resistance to flow therethrough depicted in FIG. 6B and an inertia dominant flow path having a second resistance to flow therethrough depicted in FIG. 6C. As best seen in FIG. 6A, valve element 100 is a multistage sinuous valve element having reverse of direction flow within parallel branches 102, 104 that are positioned between a common inlet 106 and a common outlet 108. In the illustrated embodiment, valve element 100 is formed on an inner plate 110 that may be coupled to an outer plate and a base pipe to form a valve assembly, as discussed herein.

When the fluid flowing through valve element 100 has a viscosity greater than the first predetermined level, the fluid follows the viscosity dominant flow path as indicated by streamlines 112 moving from left to right in FIG. 6B in a foreshorten version of branch 104. As illustrated, a high viscosity fluid such as oil, will utilize nearly the entire cross section of the sinuous conduit along the entire length of branch 104 allowing the fluid to flow at a relative high flowrate. The viscosity dominant flow path provides a low resistance flow path that minimizes losses such that production of the selected fluid is maximized. When the fluid flowing through valve element 100 has a viscosity less than the second predetermined level, the fluid follows the inertia dominant flow path as indicated by streamlines 114 moving from left to right in FIG. 6C in the foreshorten version of branch 104. As illustrated, a low viscosity fluid such as water, fails to utilize significant portions of the cross section of the sinuous conduit such as at locations 116*a*, 116*b*, 116*c*, 116*d*. The inertia dominant flow path is a high resistance, turbulent and/or self-choking flow path creating large losses and a significantly reduced flowrate such that production of the non-selected fluid is minimized.

Figure 7A:
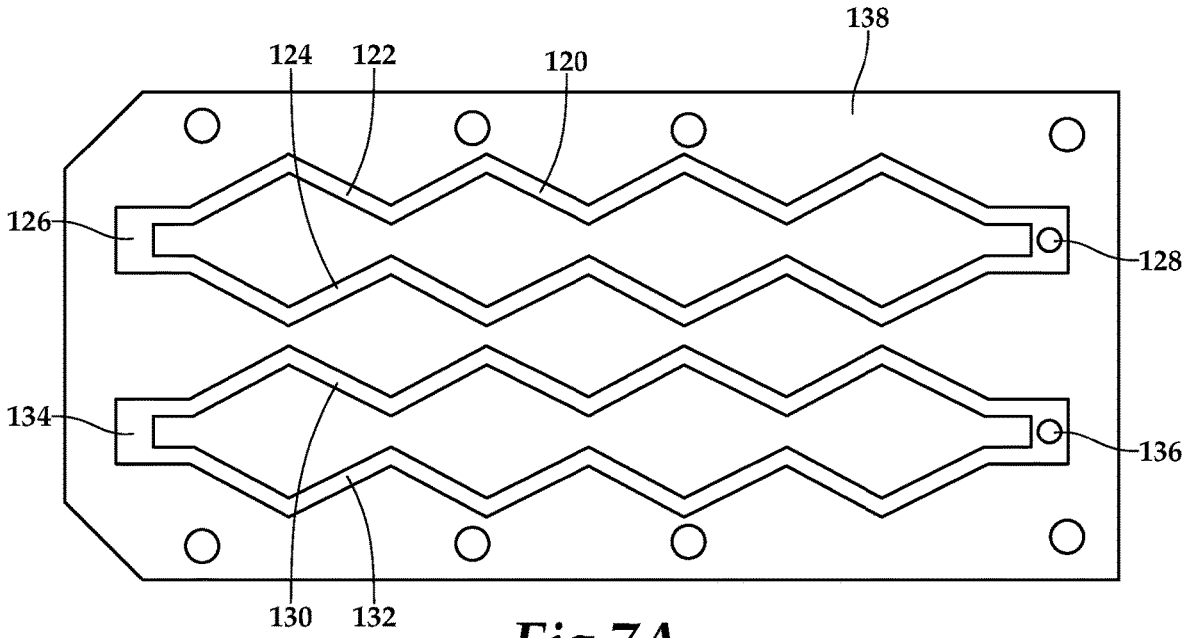
FIGS. 7A-7C are schematic illustrations of a valve element of an autonomous flow control device according to embodiments of the present disclosure.
Figure 7B:
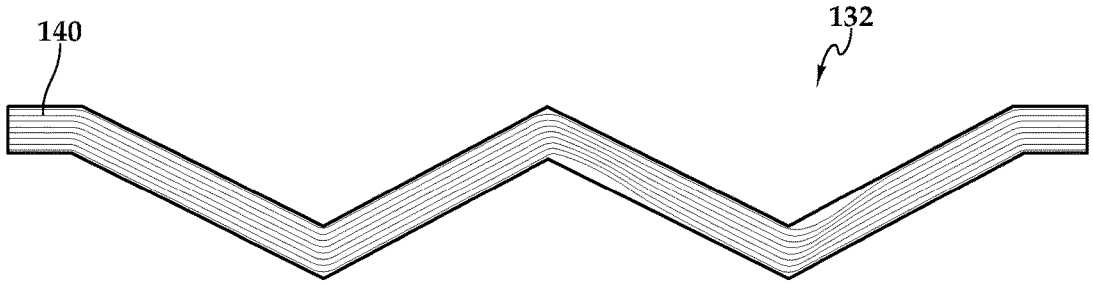
Figure 7C:
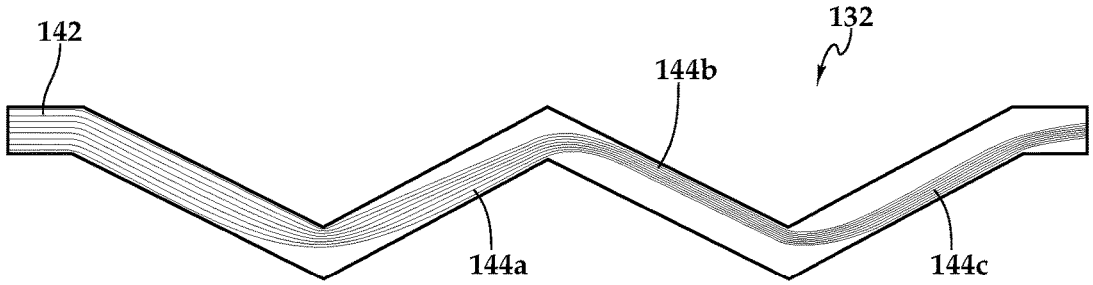

Referring next to FIGS. 7A-7C, a valve element 120 is configured to interpret the viscosity of a fluid flowing therethrough to determine whether the fluid is a selected fluid, such oil, or a non-selected fluid, such as natural gas or water. Specifically, valve element 120 includes a viscosity dominant flow path having a first resistance to flow therethrough depicted in FIG. 7B and an inertia dominant flow path having a second resistance to flow therethrough depicted in FIG. 7C. As best seen in FIG. 7A, valve element 120 is a multistage waveform valve element having parallel branches 122, 124 that are positioned between a common inlet 126 and a common outlet 128 together with parallel branches 130, 132 that are positioned between a common inlet 134 and a common outlet 136. In the illustrated embodiment, valve element 120 is formed on an inner plate 138 that may be coupled to an outer plate and a base pipe to form a valve assembly, as discussed herein.

When the fluid flowing through valve element 120 has a viscosity greater than the first predetermined level, the fluid follows the viscosity dominant flow path as indicated by streamlines 140 moving from left to right in FIG. 7B. As illustrated, a high viscosity fluid such as oil, will utilize nearly the entire cross section of the waveform conduit along the entire length of branch 132, allowing the fluid to flow at a relative high flowrate. The viscosity dominant flow path provides a low resistance flow path that minimizes losses such that production of the selected fluid is maximized. When the fluid flowing through valve element 120 has a viscosity less than the second predetermined level, the fluid follows the inertia dominant flow path as indicated by streamlines 142 moving from left to right in FIG. 7C. As illustrated, a low viscosity fluid such as water, fails to utilize significant portions of the cross section of the waveform conduit such as at locations 144*a*, 144*b*, 144*c*. The inertia dominant flow path is a high resistance, turbulent and/or self-choking flow path creating large losses and a significantly reduced flowrate such that production of the non-selected fluid is minimized.

Figure 8A:
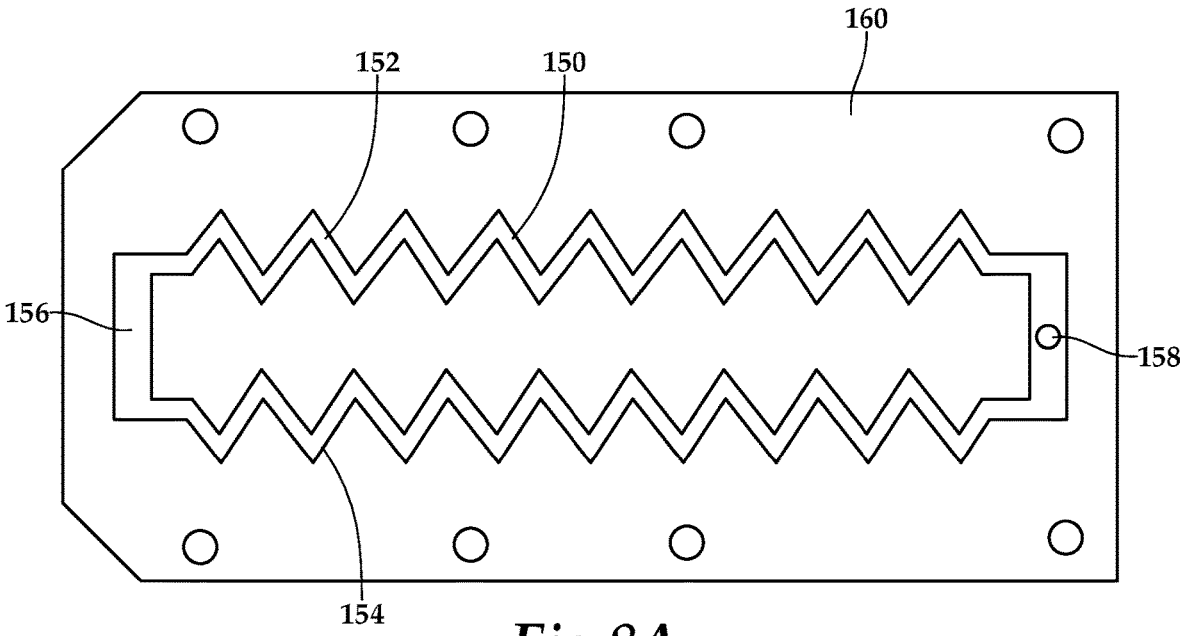
FIGS. 8A-8C are schematic illustrations of a valve element of an autonomous flow control device according to embodiments of the present disclosure.
Figure 8B:
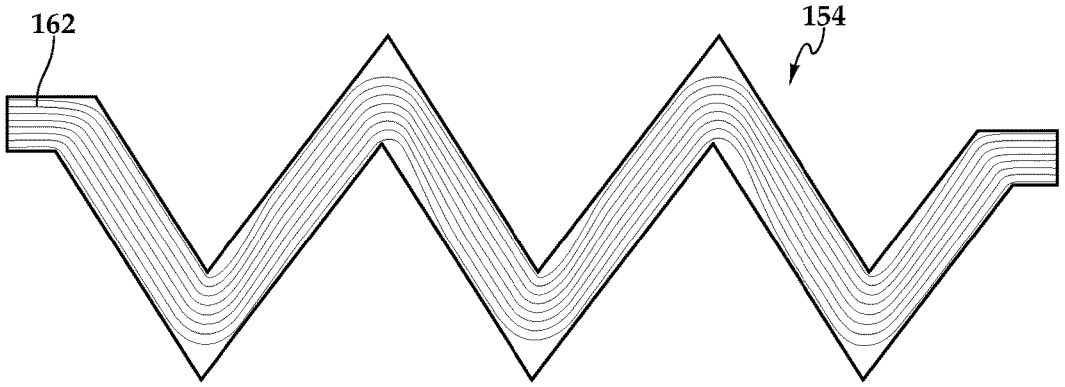
Figure 8C:
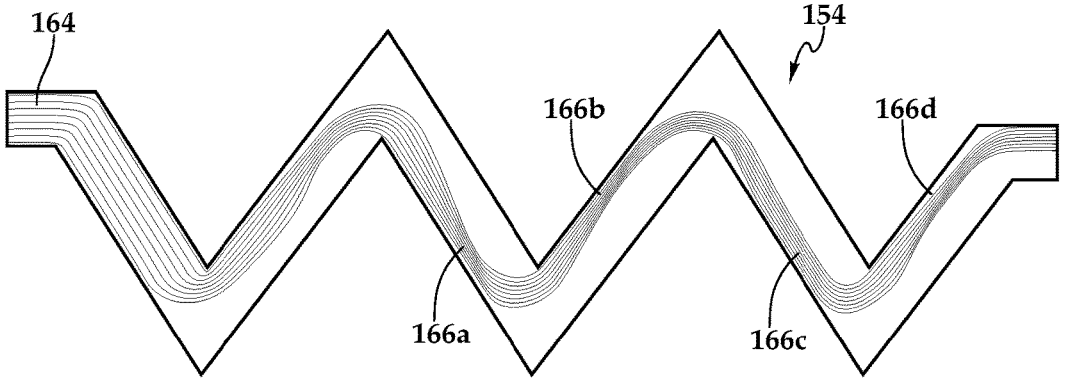

Referring next to FIGS. 8A-8C, a valve element 150 is configured to interpret the viscosity of a fluid flowing therethrough to determine whether the fluid is a selected fluid, such oil, or a non-selected fluid, such as natural gas or water. Specifically, valve element 150 includes a viscosity dominant flow path having a first resistance to flow therethrough depicted in FIG. 8B and an inertia dominant flow path having a second resistance to flow therethrough depicted in FIG. 8C. As best seen in FIG. 8A, valve element 150 is a multistage waveform valve element having parallel branches 152, 154 that are positioned between a common inlet 156 and a common outlet 158. In the illustrated embodiment, valve element 150 is formed on an inner plate 160 that may be coupled to an outer plate and a base pipe to form a valve assembly, as discussed herein.

When the fluid flowing through valve element 150 has a viscosity greater than the first predetermined level, the fluid follows the viscosity dominant flow path as indicated by streamlines 162 moving from left to right in FIG. 8B. As illustrated, a high viscosity fluid such as oil, will utilize nearly the entire cross section of the waveform conduit along the entire length of branch 154, allowing the fluid to flow at a relative high flowrate. The viscosity dominant flow path provides a low resistance flow path that minimizes losses such that production of the selected fluid is maximized. When the fluid flowing through valve element 150 has a viscosity less than the second predetermined level, the fluid follows the inertia dominant flow path as indicated by streamlines 164 moving from left to right in FIG. 8C. As illustrated, a low viscosity fluid such as water, fails to utilize significant portions of the cross section of the waveform conduit such as at locations 166*a*, 166*b*, 166*c*, 166*d*. The inertia dominant flow path is a high resistance, turbulent and/or self-choking flow path creating large losses and a significantly reduced flowrate such that production of the non-selected fluid is minimized.

Figure 9A:
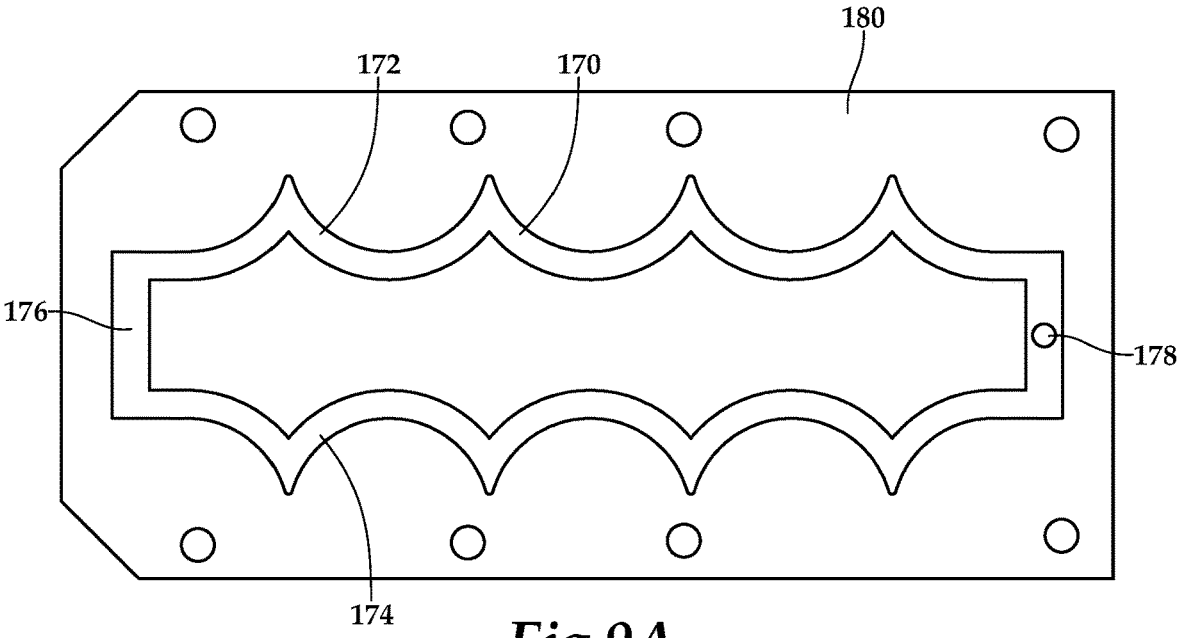
FIGS. 9A-9C are schematic illustrations of a valve element of an autonomous flow control device according to embodiments of the present disclosure.
Figure 9B:
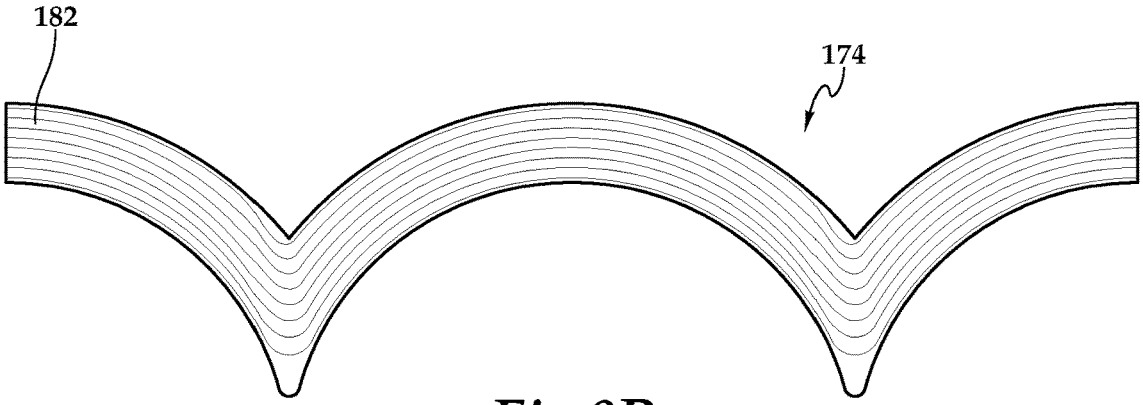
Figure 9C:
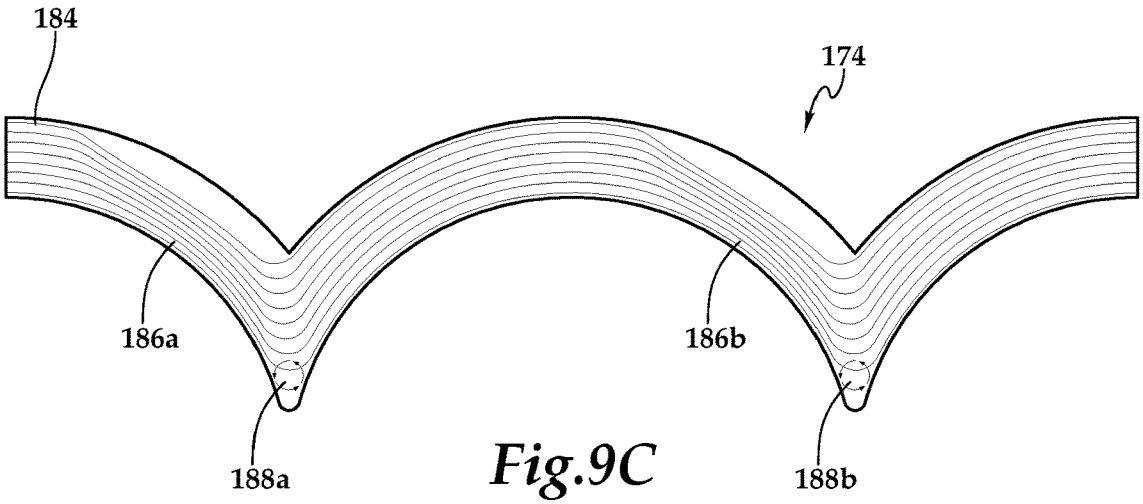

Referring next to FIGS. 9A-9C, a valve element 170 is configured to interpret the viscosity of a fluid flowing therethrough to determine whether the fluid is a selected fluid, such oil, or a non-selected fluid, such as natural gas or water. Specifically, valve element 170 includes a viscosity dominant flow path having a first resistance to flow therethrough depicted in FIG. 9B and an inertia dominant flow path having a second resistance to flow therethrough depicted in FIG. 9C. As best seen in FIG. 9A, valve element 170 is a multistage waveform valve element having parallel branches 172, 174 that are positioned between a common inlet 176 and a common outlet 178. In the illustrated embodiment, valve element 170 is formed on an inner plate 180 that may be coupled to an outer plate and a base pipe to form a valve assembly, as discussed herein.

When the fluid flowing through valve element 170 has a viscosity greater than the first predetermined level, the fluid follows the viscosity dominant flow path as indicated by streamlines 182 moving from left to right in FIG. 9B. As illustrated, a high viscosity fluid such as oil, will utilize nearly the entire cross section of the waveform conduit along the entire length of branch 174, allowing the fluid to flow at a relative high flowrate. The viscosity dominant flow path provides a low resistance flow path that minimizes losses such that production of the selected fluid is maximized. When the fluid flowing through valve element 170 has a viscosity less than the second predetermined level, the fluid follows the inertia dominant flow path as indicated by streamlines 184 moving from left to right in FIG. 9C. As illustrated, a low viscosity fluid such as water, fails to utilize significant portions of the cross section of the waveform conduit such as at locations 186*a*, 186*b* and engages in swirling and/or mixing flow such as at locations 188*a*, 188*b*, as indicated by the circular arrows. The inertia dominant flow path is a high resistance, turbulent and/or self-choking flow path creating large losses and a significantly reduced flowrate such that production of the non-selected fluid is minimized.

Figure 10A:
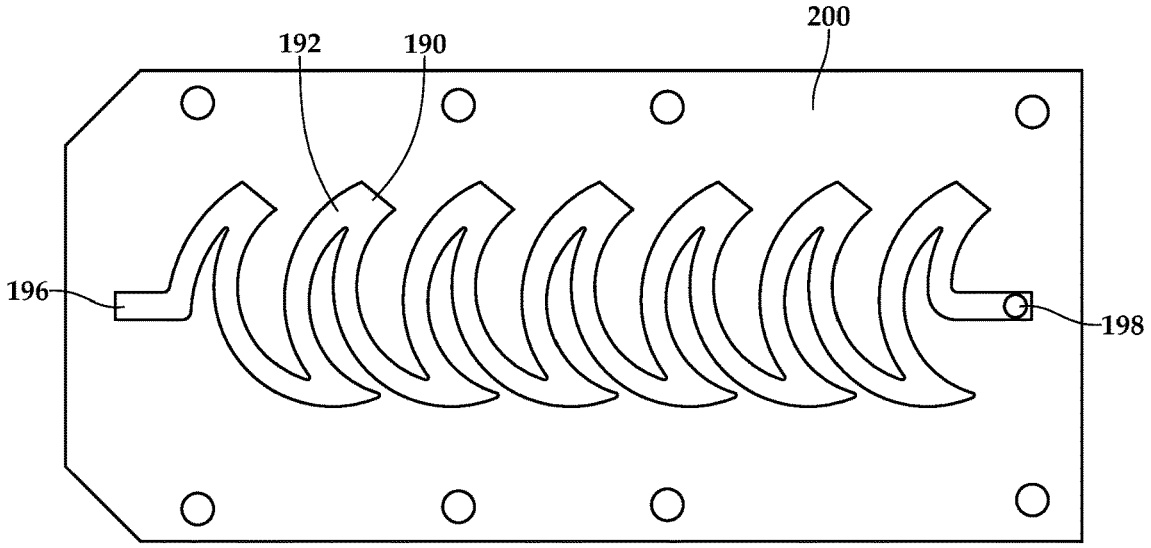
FIGS. 10A-10C are schematic illustrations of a valve element of an autonomous flow control device according to embodiments of the present disclosure.
Figure 10B:
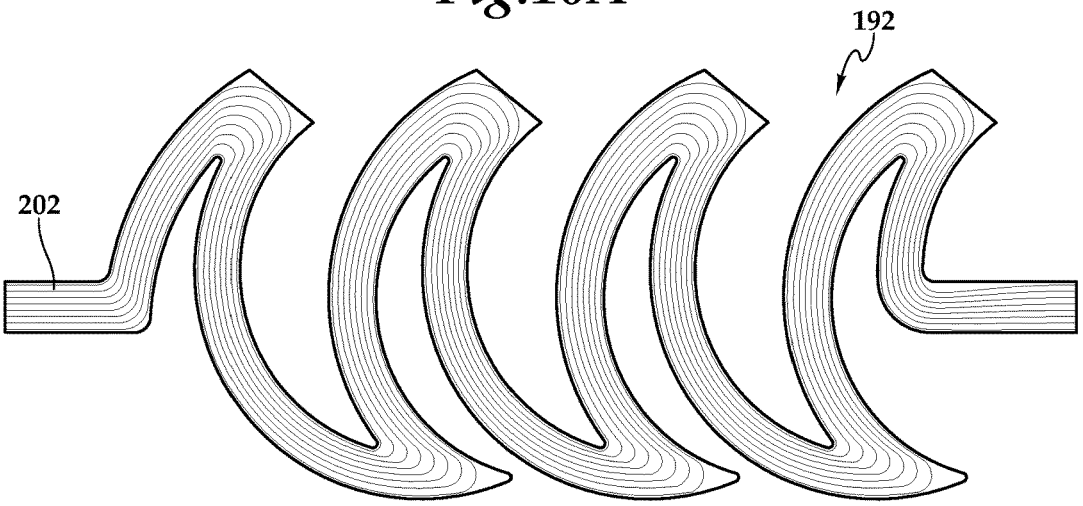
Figure 10C:
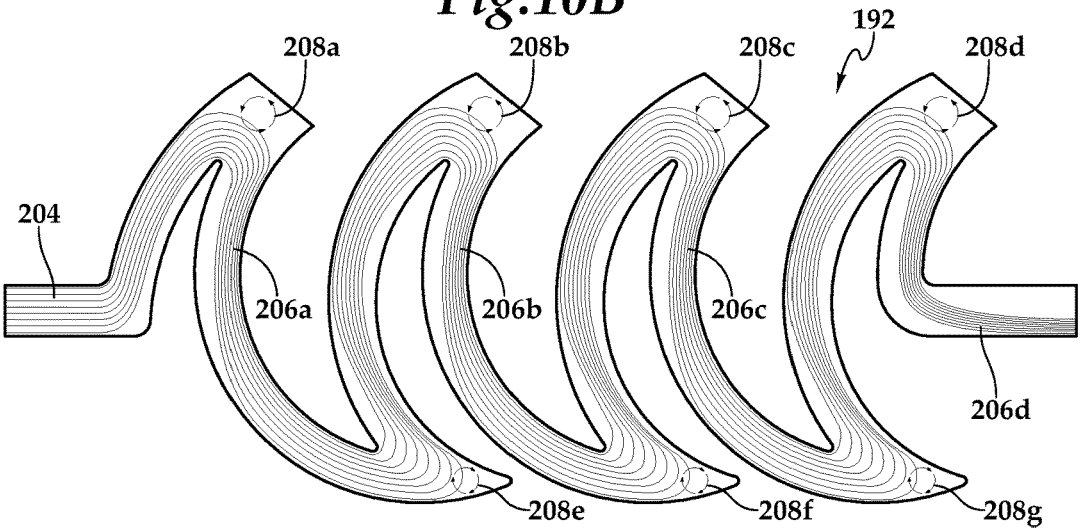

Referring next to FIGS. 10A-10C, a valve element 190 is configured to interpret the viscosity of a fluid flowing therethrough to determine whether the fluid is a selected fluid, such oil, or a non-selected fluid, such as natural gas or water. Specifically, valve element 190 includes a viscosity dominant flow path having a first resistance to flow therethrough depicted in FIG. 10B and an inertia dominant flow path having a second resistance to flow therethrough depicted in FIG. 10C. As best seen in FIG. 10A, valve element 190 is a multistage sinuous valve element having a single branch 192 that is positioned between an inlet 196 and an outlet 198. In the illustrated embodiment, valve element 190 is formed on an inner plate 200 that may be coupled to an outer plate and a base pipe to form a valve assembly, as discussed herein.

When the fluid flowing through valve element 190 has a viscosity greater than the first predetermined level, the fluid follows the viscosity dominant flow path as indicated by streamlines 202 moving from left to right in FIG. 10B. As illustrated, a high viscosity fluid such as oil, will utilize nearly the entire cross section of the sinuous conduit along the entire length of branch 192, allowing the fluid to flow at a relative high flowrate. The viscosity dominant flow path provides a low resistance flow path that minimizes losses such that production of the selected fluid is maximized. When the fluid flowing through valve element 190 has a viscosity less than the second predetermined level, the fluid follows the inertia dominant flow path as indicated by streamlines 204 moving from left to right in FIG. 10C. As illustrated, a low viscosity fluid such as water, fails to utilize significant portions of the cross section of the sinuous conduit such as at locations 206*a*, 206*b*, 206*c*, 206*d* and engages in swirling and/or mixing flow such as at locations 208*a*, 208*b*, 208*c*, 208*d*, 208*e*, 208*f*, 208*g*, as indicated by the circular arrows. The inertia dominant flow path is a high resistance, turbulent and/or self-choking flow path creating large losses and a significantly reduced flowrate such that production of the non-selected fluid is minimized.

Figure 11A:
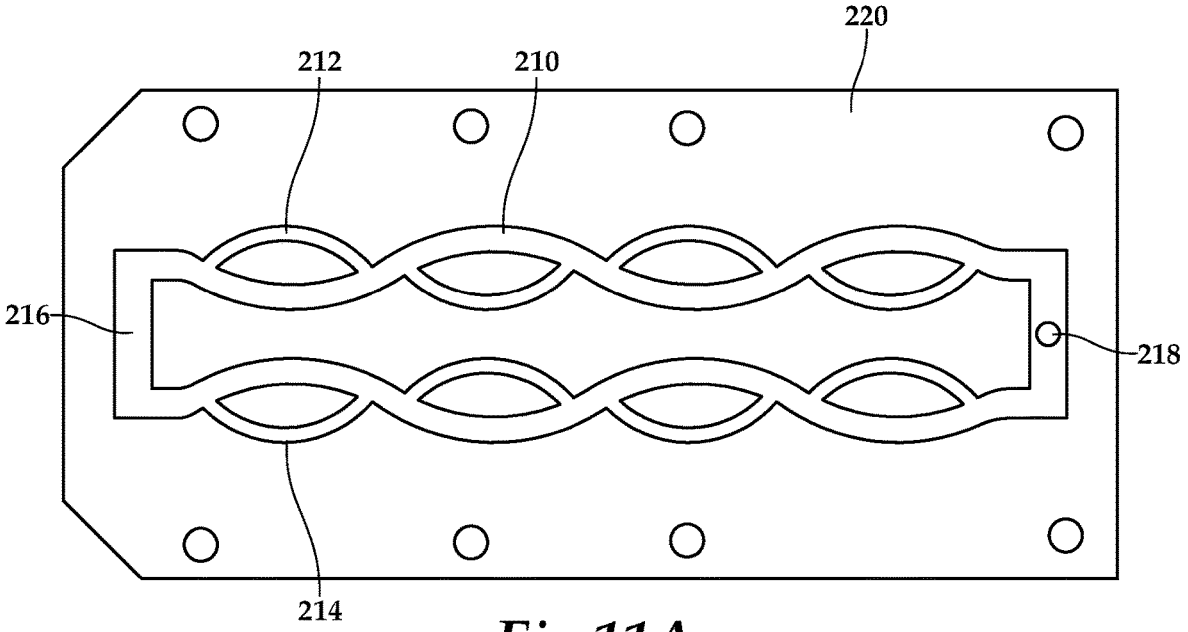
FIGS. 11A-11C are schematic illustrations of a valve element of an autonomous flow control device according to embodiments of the present disclosure.
Figure 11B:
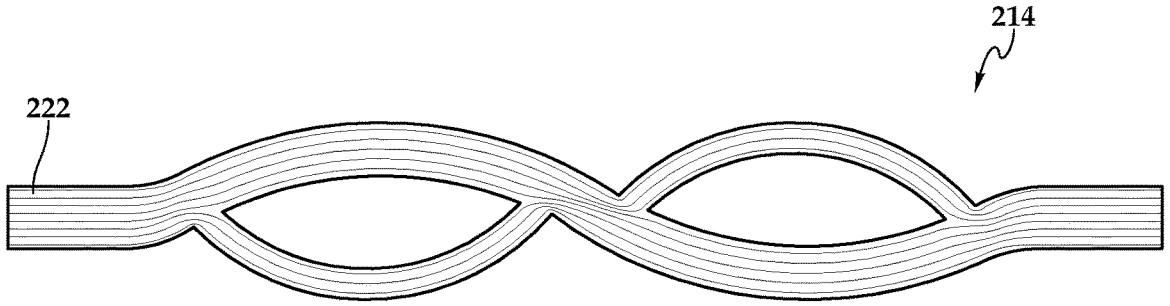
Figure 11C:
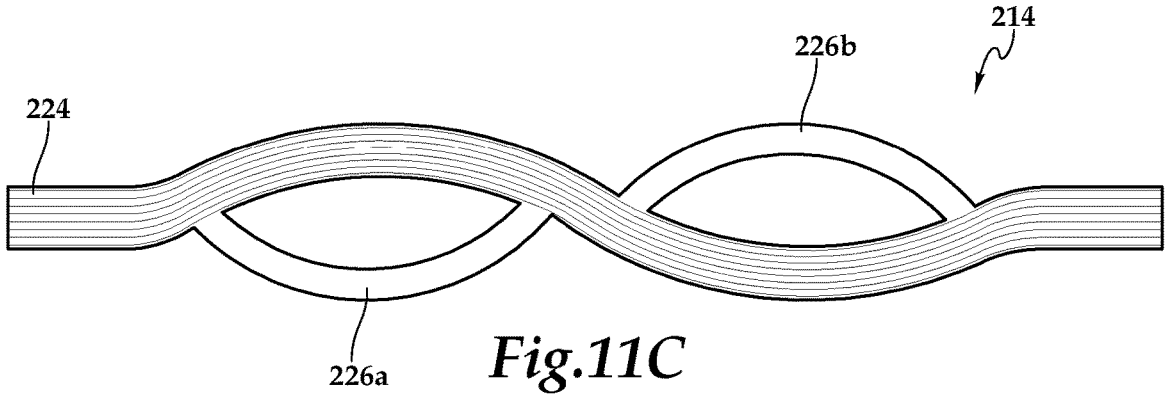

Referring next to FIGS. 11A-11C, a valve element 210 is configured to interpret the viscosity of a fluid flowing therethrough to determine whether the fluid is a selected fluid, such oil, or a non-selected fluid, such as natural gas or water. Specifically, valve element 210 includes a viscosity dominant flow path having a first resistance to flow therethrough depicted in FIG. 11B and an inertia dominant flow path having a second resistance to flow therethrough depicted in FIG. 11C. As best seen in FIG. 11A, valve element 210 is a multistage parallel path valve element having parallel branches 212, 214 that are positioned between a common inlet 216 and a common outlet 218. In the illustrated embodiment, valve element 210 is formed on an inner plate 220 that may be coupled to an outer plate and a base pipe to form a valve assembly, as discussed herein.

When the fluid flowing through valve element 210 has a viscosity greater than the first predetermined level, the fluid follows the viscosity dominant flow path as indicated by streamlines 222 moving from left to right in FIG. 11B. As illustrated, a high viscosity fluid such as oil, will utilize nearly the entire cross section of the parallel path conduit along the entire length of branch 214, allowing the fluid to flow at a relative high flowrate. The viscosity dominant flow path provides a low resistance flow path that minimizes losses such that production of the selected fluid is maximized. When the fluid flowing through valve element 210 has a viscosity less than the second predetermined level, the fluid follows the inertia dominant flow path as indicated by streamlines 224 moving from left to right in FIG. 11C. As illustrated, a low viscosity fluid such as water, fails to utilize significant portions of the cross section of the parallel path conduit such as at locations 226*a*, 226*b*. The inertia dominant flow path is a high resistance and/or self-choking flow path creating large losses and a significantly reduced flowrate such that production of the non-selected fluid is minimized.

Figure 12A:
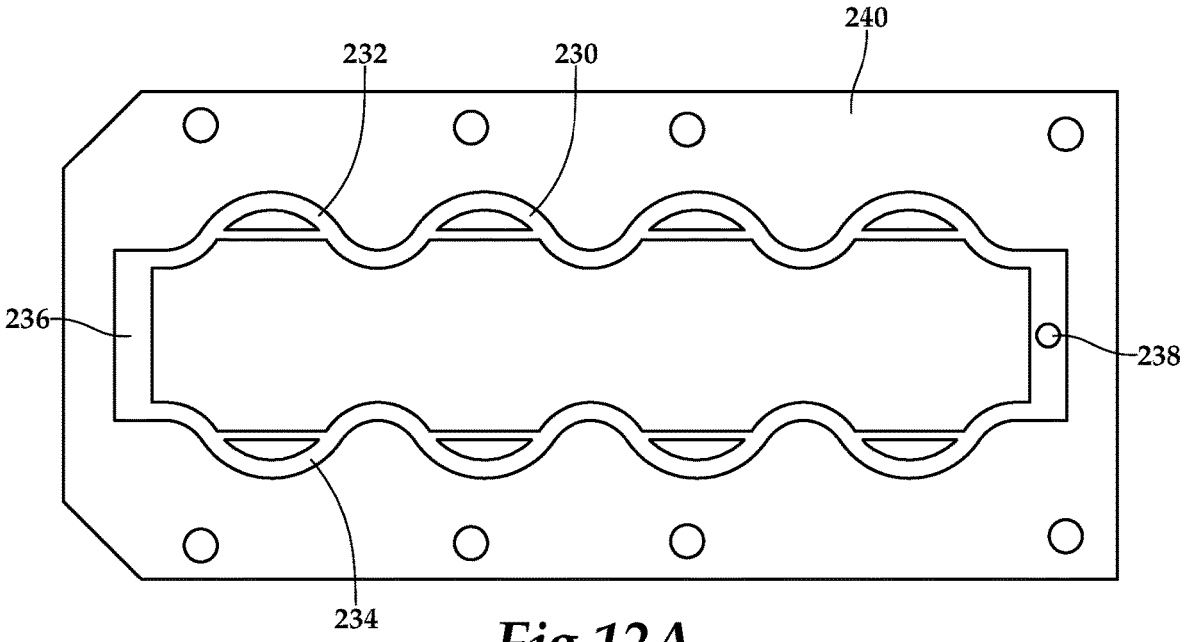
FIGS. 12A-12C are schematic illustrations of a valve element of an autonomous flow control device according to embodiments of the present disclosure.
Figure 12B:
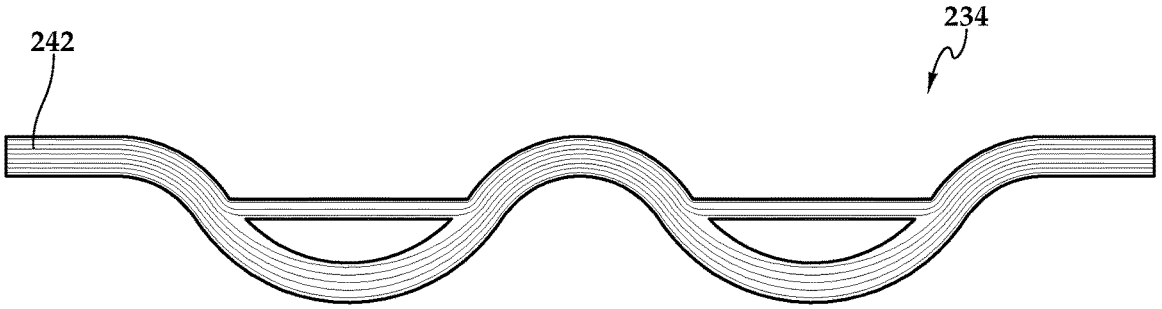
Figure 12C:
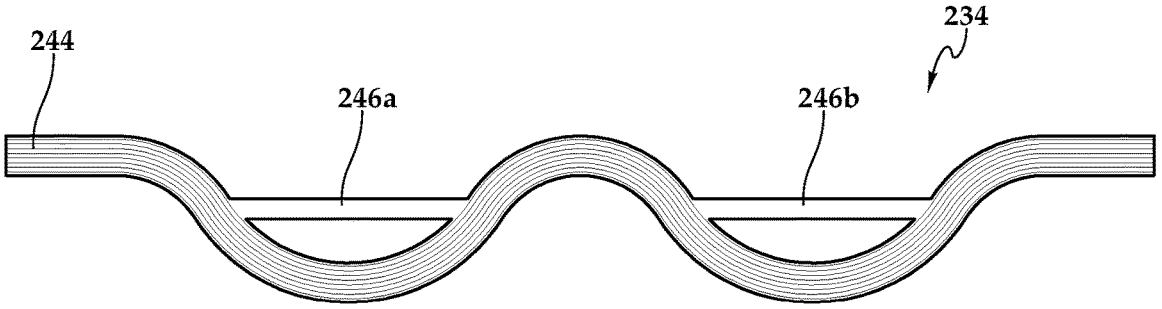

Referring next to FIGS. 12A-12C, a valve element 230 is configured to interpret the viscosity of a fluid flowing therethrough to determine whether the fluid is a selected fluid, such oil, or a non-selected fluid, such as natural gas or water. Specifically, valve element 230 includes a viscosity dominant flow path having a first resistance to flow therethrough depicted in FIG. 12B and an inertia dominant flow path having a second resistance to flow therethrough depicted in FIG. 12C. As best seen in FIG. 12A, valve element 230 is a multistage parallel path valve element having parallel branches 232, 234 that are positioned between a common inlet 236 and a common outlet 238. In the illustrated embodiment, valve element 230 is formed on an inner plate 240 that may be coupled to an outer plate and a base pipe to form a valve assembly, as discussed herein.

When the fluid flowing through valve element 230 has a viscosity greater than the first predetermined level, the fluid follows the viscosity dominant flow path as indicated by streamlines 242 moving from left to right in FIG. 12B. As illustrated, a high viscosity fluid such as oil, will utilize nearly the entire cross section of the parallel path conduit along the entire length of branch 234, allowing the fluid to flow at a relative high flowrate. The viscosity dominant flow path provides a low resistance flow path that minimizes losses such that production of the selected fluid is maximized. When the fluid flowing through valve element 230 has a viscosity less than the second predetermined level, the fluid follows the inertia dominant flow path as indicated by streamlines 244 moving from left to right in FIG. 12C. As illustrated, a low viscosity fluid such as water, fails to utilize significant portions of the cross section of the parallel path conduit such as at locations 246*a*, 246*b*. The inertia dominant flow path is a high resistance and/or self-choking flow path creating large losses and a significantly reduced flowrate such that production of the non-selected fluid is minimized.

Figure 13A:
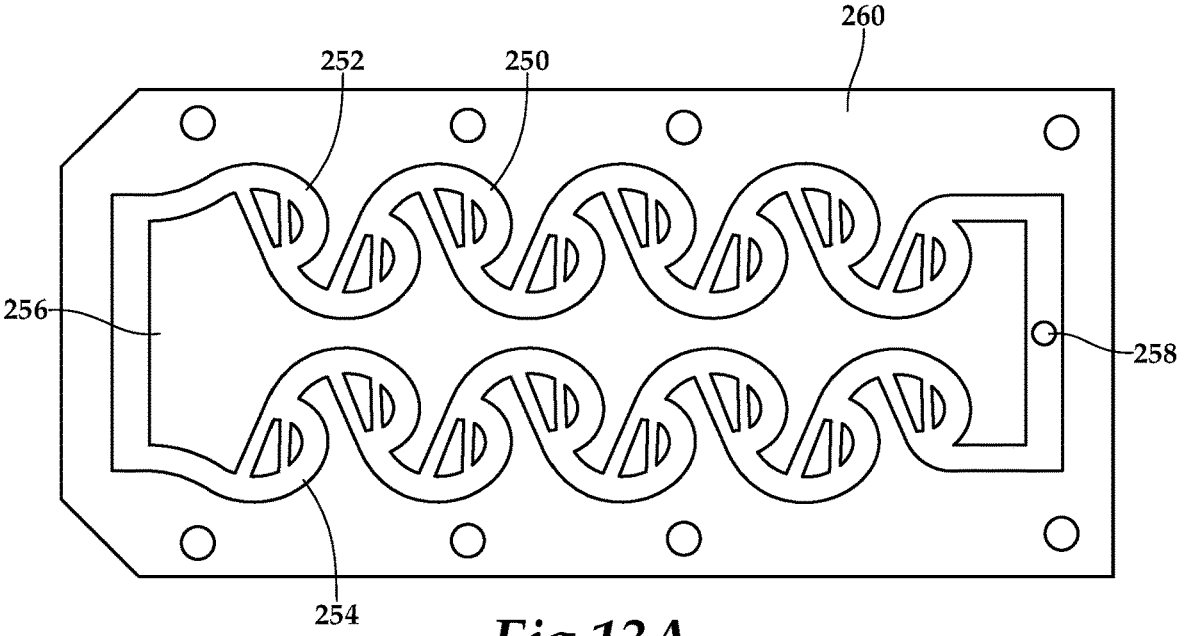
FIGS. 13A-13C are schematic illustrations of a valve element of an autonomous flow control device according to embodiments of the present disclosure.
Figure 13B:
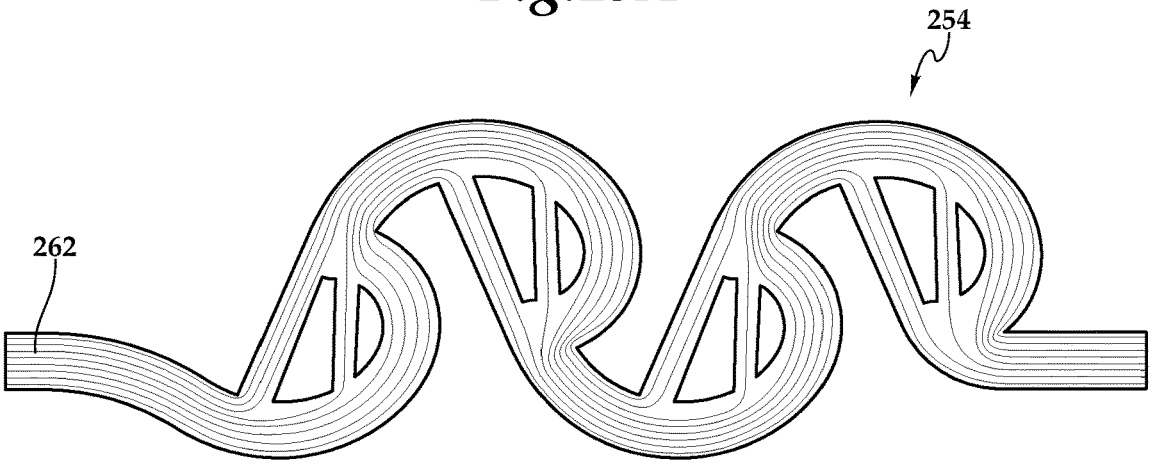
Figure 13C:
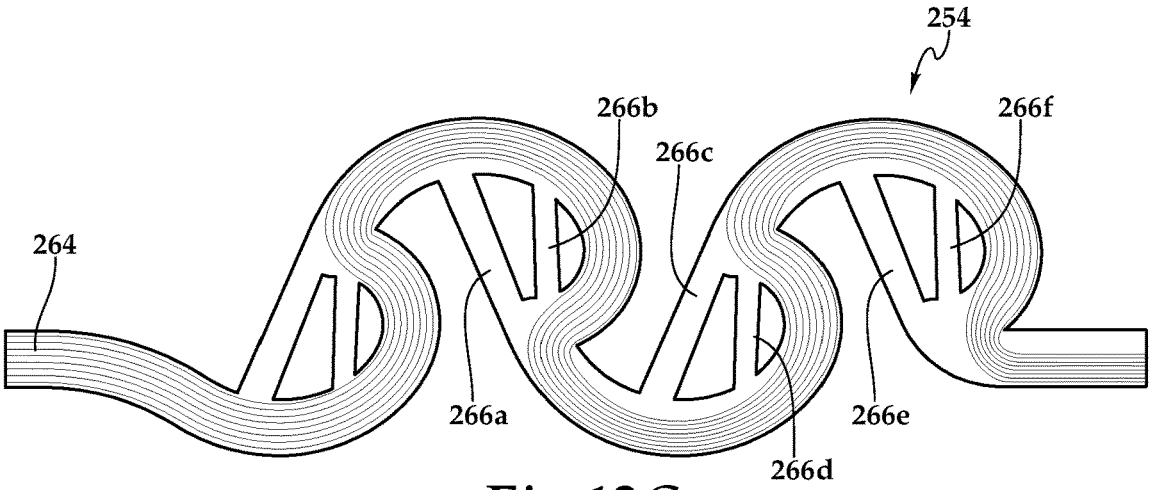

Referring next to FIGS. 13A-13C, a valve element 250 is configured to interpret the viscosity of a fluid flowing therethrough to determine whether the fluid is a selected fluid, such oil, or a non-selected fluid, such as natural gas or water. Specifically, valve element 250 includes a viscosity dominant flow path having a first resistance to flow therethrough depicted in FIG. 13B and an inertia dominant flow path having a second resistance to flow therethrough depicted in FIG. 13C. As best seen in FIG. 13A, valve element 250 is a multistage triple parallel path valve element having parallel branches 252, 254 that are positioned between a common inlet 256 and a common outlet 258. In the illustrated embodiment, valve element 250 is formed on an inner plate 260 that may be coupled to an outer plate and a base pipe to form a valve assembly, as discussed herein.

When the fluid flowing through valve element 250 has a viscosity greater than the first predetermined level, the fluid follows the viscosity dominant flow path as indicated by streamlines 262 moving from left to right in FIG. 13B. As illustrated, a high viscosity fluid such as oil, will utilize nearly the entire cross section of the triple parallel path conduit along the entire length of branch 254, allowing the fluid to flow at a relative high flowrate. The viscosity dominant flow path provides a low resistance flow path that minimizes losses such that production of the selected fluid is maximized. When the fluid flowing through valve element 250 has a viscosity less than the second predetermined level, the fluid follows the inertia dominant flow path as indicated by streamlines 264 moving from left to right in FIG. 13C. As illustrated, a low viscosity fluid such as water, fails to utilize significant portions of the cross section of the triple parallel path conduit such as at locations 266*a*, 266*b*, 266*c*, 266*d*, 266*e*, 266*f*. The inertia dominant flow path is a high resistance, turbulent and/or self-choking flow path creating large losses and a significantly reduced flowrate such that production of the non-selected fluid is minimized.

Figure 14A:
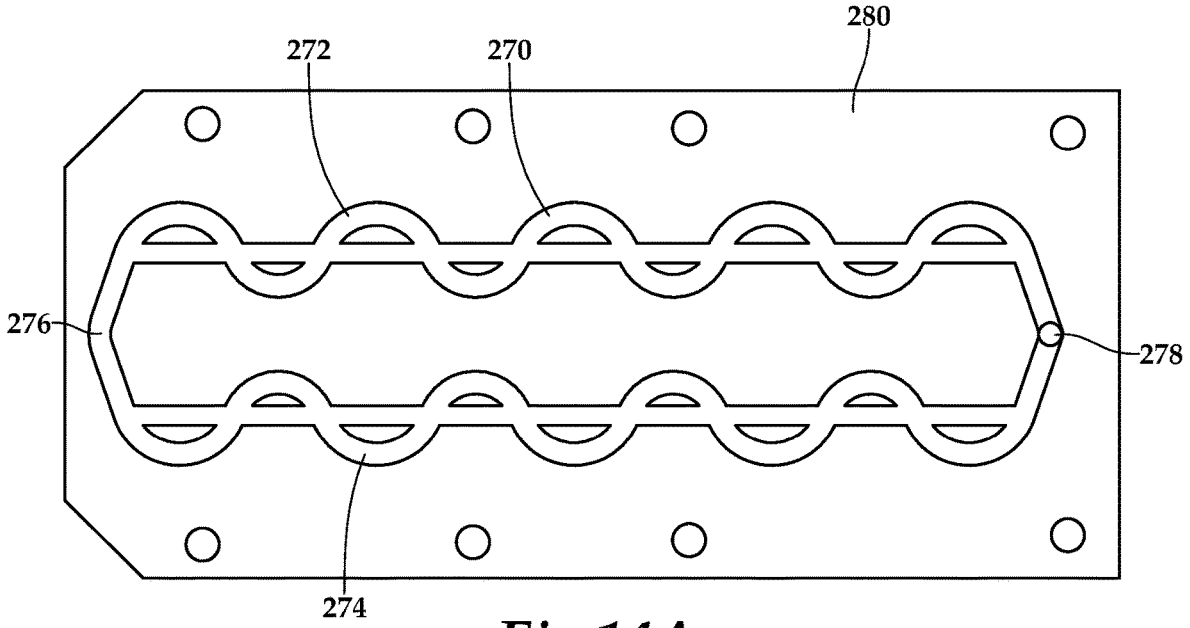
FIGS. 14A-14C are schematic illustrations of a valve element of an autonomous flow control device according to embodiments of the present disclosure.
Figure 14B:
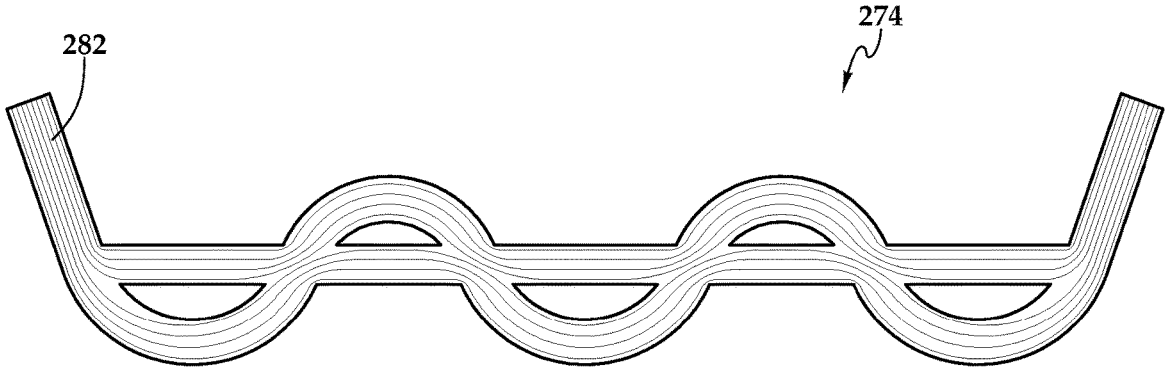
Figure 14C:
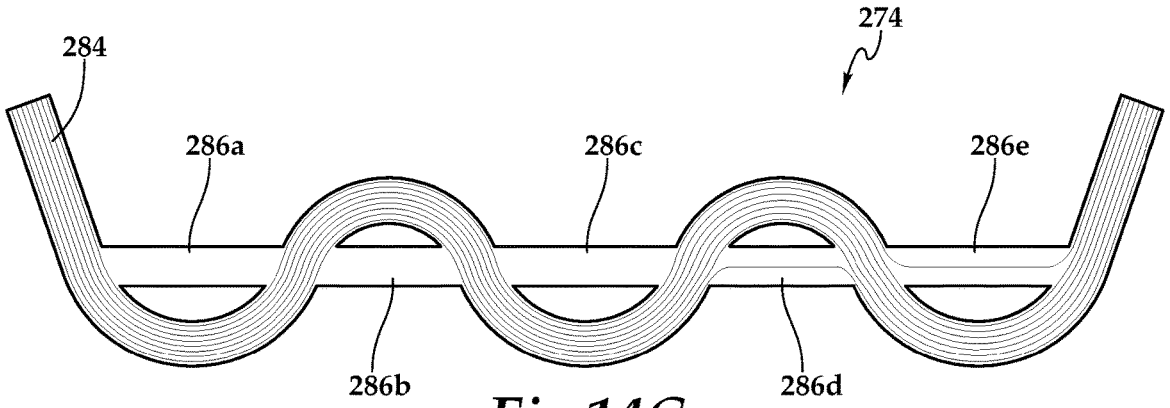

Referring next to FIGS. 14A-14C, a valve element 270 is configured to interpret the viscosity of a fluid flowing therethrough to determine whether the fluid is a selected fluid, such oil, or a non-selected fluid, such as natural gas or water. Specifically, valve element 270 includes a viscosity dominant flow path having a first resistance to flow therethrough depicted in FIG. 14B and an inertia dominant flow path having a second resistance to flow therethrough depicted in FIG. 14C. As best seen in FIG. 14A, valve element 270 is a multistage parallel path valve element having parallel branches 272, 274 that are positioned between a common inlet 276 and a common outlet 278. In the illustrated embodiment, valve element 270 is formed on an inner plate 280 that may be coupled to an outer plate and a base pipe to form a valve assembly, as discussed herein.

When the fluid flowing through valve element 270 has a viscosity greater than the first predetermined level, the fluid follows the viscosity dominant flow path as indicated by streamlines 282 moving from left to right in FIG. 14B. As illustrated, a high viscosity fluid such as oil, will utilize nearly the entire cross section of the parallel path conduit along the entire length of branch 274, allowing the fluid to flow at a relative high flowrate. The viscosity dominant flow path provides a low resistance flow path that minimizes losses such that production of the selected fluid is maximized. When the fluid flowing through valve element 270 has a viscosity less than the second predetermined level, the fluid follows the inertia dominant flow path as indicated by streamlines 284 moving from left to right in FIG. 14C. As illustrated, a low viscosity fluid such as water, fails to utilize significant portions of the cross section of the parallel path conduit such as at locations 286*a*, 286*b*, 286*c*, 286*d*, 286*e*. The inertia dominant flow path is a high resistance and/or self-choking flow path creating large losses and a significantly reduced flowrate such that production of the non-selected fluid is minimized.

Figure 15A:
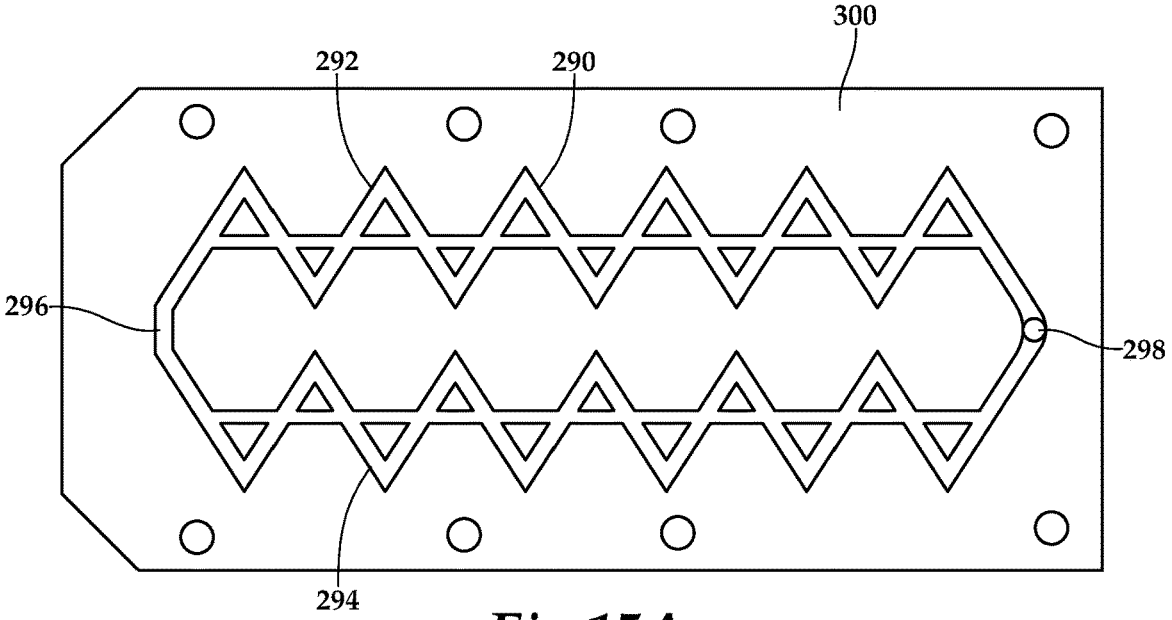
FIGS. 15A-15C are schematic illustrations of a valve element of an autonomous flow control device according to embodiments of the present disclosure.
Figure 15B:
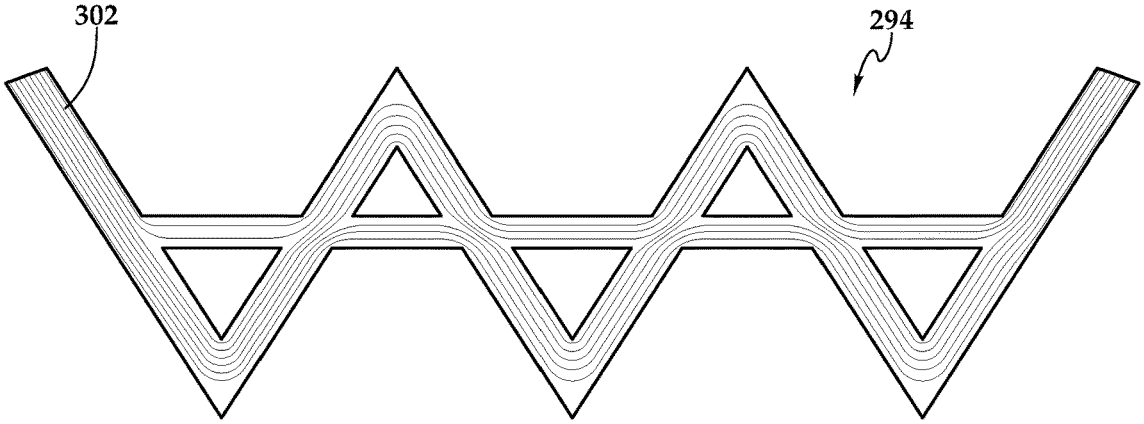
Figure 15C:
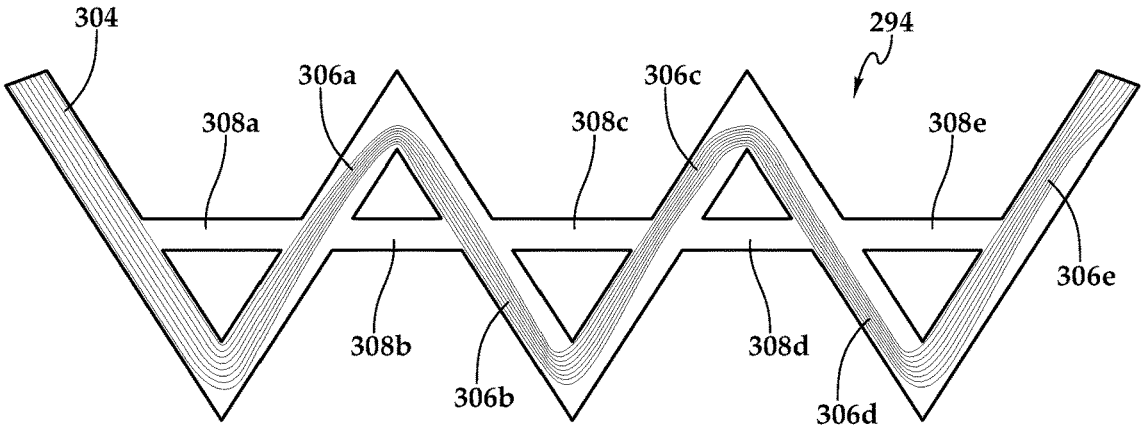

Referring next to FIGS. 15A-15C, a valve element 290 is configured to interpret the viscosity of a fluid flowing therethrough to determine whether the fluid is a selected fluid, such oil, or a non-selected fluid, such as natural gas or water. Specifically, valve element 290 includes a viscosity dominant flow path having a first resistance to flow therethrough depicted in FIG. 15B and an inertia dominant flow path having a second resistance to flow therethrough depicted in FIG. 15C. As best seen in FIG. 15A, valve element 290 is a multistage parallel path valve element having parallel branches 292, 294 that are positioned between a common inlet 296 and a common outlet 298. In the illustrated embodiment, valve element 290 is formed on an inner plate 300 that may be coupled to an outer plate and a base pipe to form a valve assembly, as discussed herein.

When the fluid flowing through valve element 290 has a viscosity greater than the first predetermined level, the fluid follows the viscosity dominant flow path as indicated by streamlines 302 moving from left to right in FIG. 15B. As illustrated, a high viscosity fluid such as oil, will utilize nearly the entire cross section of the parallel path conduit along the entire length of branch 294, allowing the fluid to flow at a relative high flowrate. The viscosity dominant flow path provides a low resistance flow path that minimizes losses such that production of the selected fluid is maximized. When the fluid flowing through valve element 290 has a viscosity less than the second predetermined level, the fluid follows the inertia dominant flow path as indicated by streamlines 304 moving from left to right in FIG. 15C. As illustrated, a low viscosity fluid such as water, fails to utilize significant portions of the cross section of the parallel path conduit such as at locations 306*a*, 306*b*, 306*c*, 306*d*, 306*e* and at locations 308*a*, 308*b*, 308*c*, 308*d*, 308*e*. The inertia dominant flow path is a high resistance and/or self-choking flow path creating large losses and a significantly reduced flowrate such that production of the non-selected fluid is minimized.

Figure 16A:
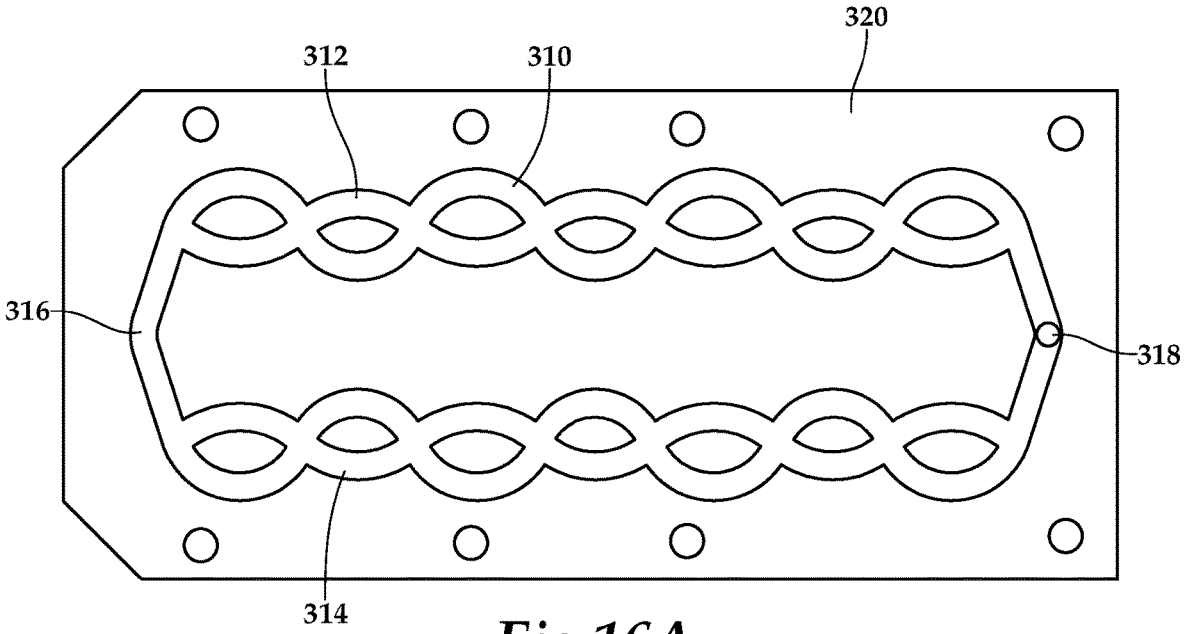
FIGS. 16A-16C are schematic illustrations of a valve element of an autonomous flow control device according to embodiments of the present disclosure.
Figure 16B:
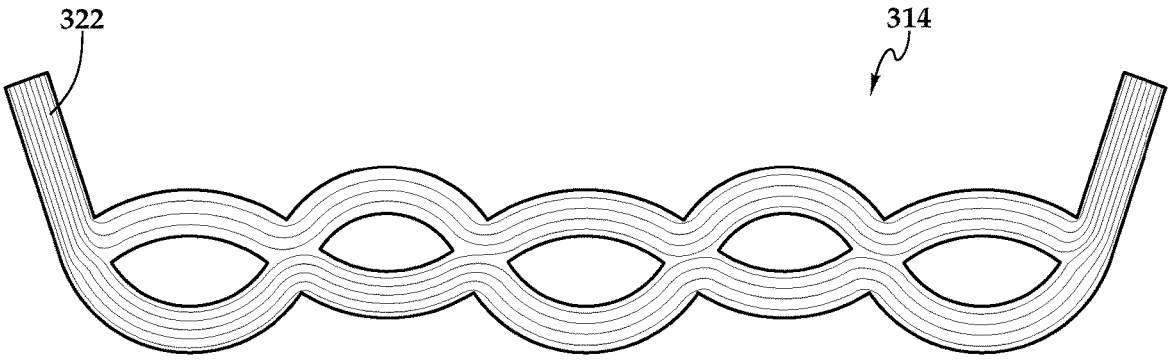
Figure 16C:
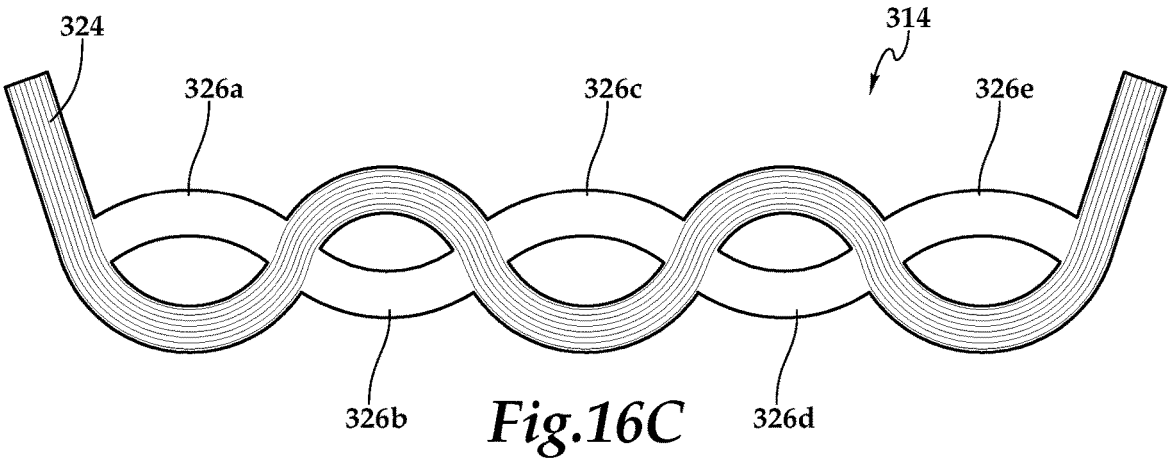

Referring next to FIGS. 16A-16C, a valve element 310 is configured to interpret the viscosity of a fluid flowing therethrough to determine whether the fluid is a selected fluid, such oil, or a non-selected fluid, such as natural gas or water. Specifically, valve element 310 includes a viscosity dominant flow path having a first resistance to flow therethrough depicted in FIG. 16B and an inertia dominant flow path having a second resistance to flow therethrough depicted in FIG. 16C. As best seen in FIG. 16A, valve element 310 is a multistage parallel path valve element having parallel branches 312, 314 that are positioned between a common inlet 316 and a common outlet 318. In the illustrated embodiment, valve element 310 is formed on an inner plate 320 that may be coupled to an outer plate and a base pipe to form a valve assembly, as discussed herein.

When the fluid flowing through valve element 310 has a viscosity greater than the first predetermined level, the fluid follows the viscosity dominant flow path as indicated by streamlines 322 moving from left to right in FIG. 16B. As illustrated, a high viscosity fluid such as oil, will utilize nearly the entire cross section of the parallel path conduit along the entire length of branch 314, allowing the fluid to flow at a relative high flowrate. The viscosity dominant flow path provides a low resistance flow path that minimizes losses such that production of the selected fluid is maximized. When the fluid flowing through valve element 310 has a viscosity less than the second predetermined level, the fluid follows the inertia dominant flow path as indicated by streamlines 324 moving from left to right in FIG. 16C. As illustrated, a low viscosity fluid such as water, fails to utilize significant portions of the cross section of the parallel path conduit such as at locations 326*a*, 326*b*, 326*c*, 326*d*, 326*e*. The inertia dominant flow path is a high resistance and/or self-choking flow path creating large losses and a significantly reduced flowrate such that production of the non-selected fluid is minimized.

Figure 17A:
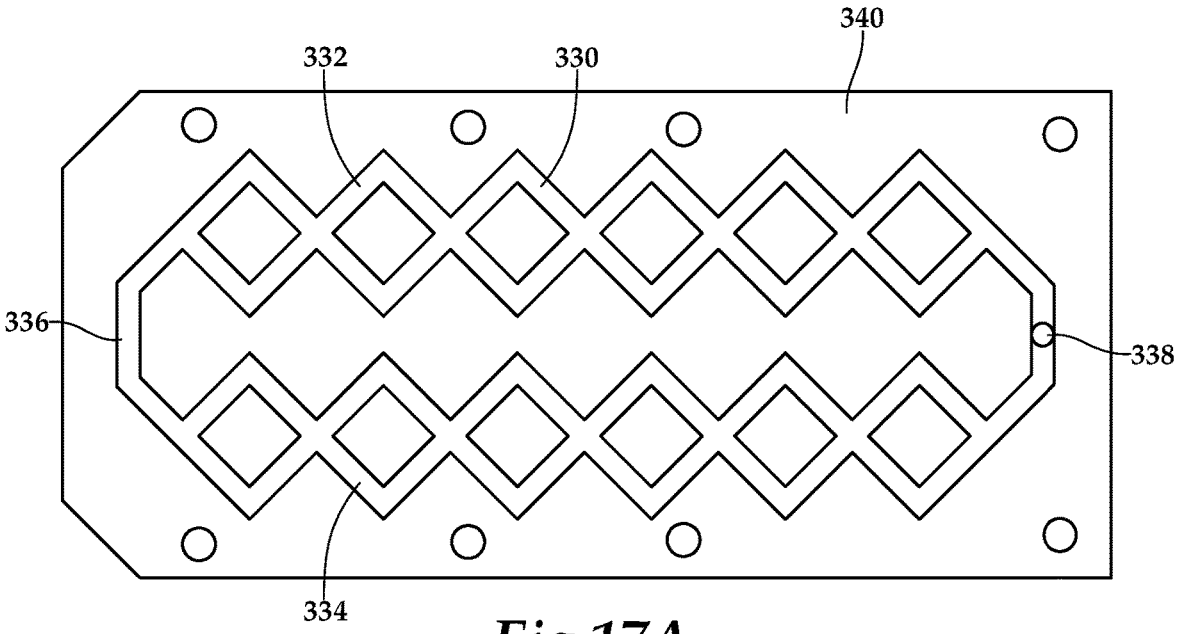
FIGS. 17A-17C are schematic illustrations of a valve element of an autonomous flow control device according to embodiments of the present disclosure.
Figure 17B:
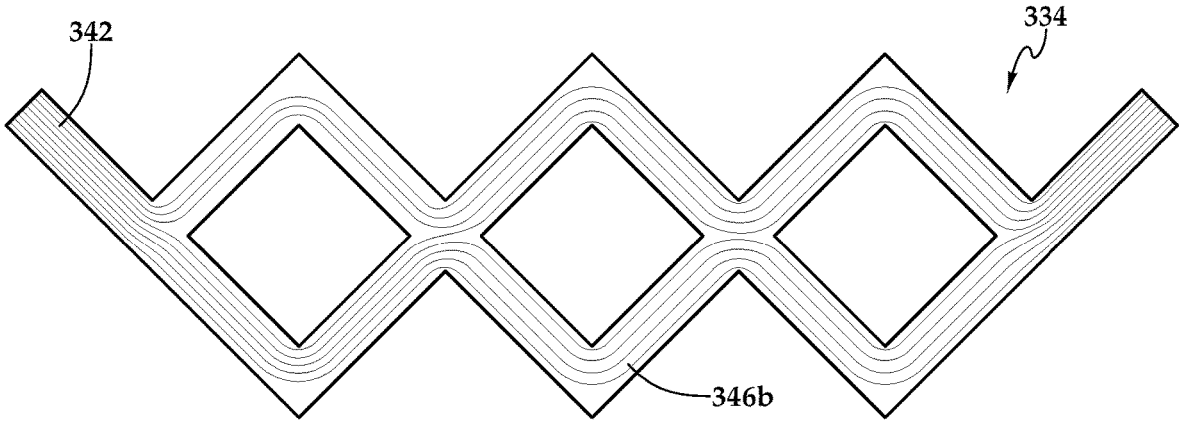
Figure 17C:
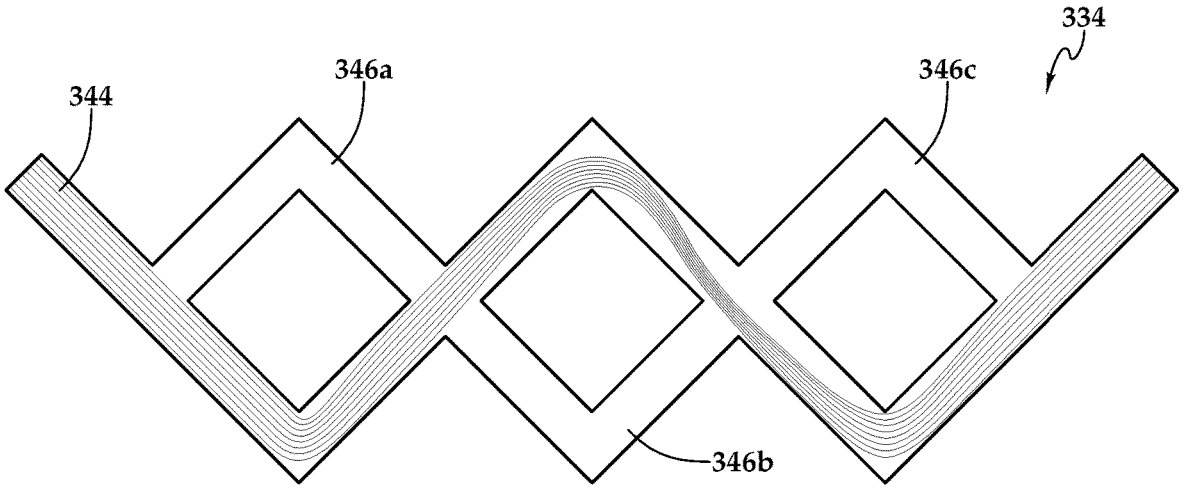

Referring next to FIGS. 17A-17C, a valve element 330 is configured to interpret the viscosity of a fluid flowing therethrough to determine whether the fluid is a selected fluid, such oil, or a non-selected fluid, such as natural gas or water. Specifically, valve element 330 includes a viscosity dominant flow path having a first resistance to flow therethrough depicted in FIG. 17B and an inertia dominant flow path having a second resistance to flow therethrough depicted in FIG. 17C. As best seen in FIG. 17A, valve element 330 is a multistage parallel path valve element having parallel branches 332, 334 that are positioned between a common inlet 336 and a common outlet 338. In the illustrated embodiment, valve element 330 is formed on an inner plate 340 that may be coupled to an outer plate and a base pipe to form a valve assembly, as discussed herein.

When the fluid flowing through valve element 330 has a viscosity greater than the first predetermined level, the fluid follows the viscosity dominant flow path as indicated by streamlines 342 moving from left to right in FIG. 17B. As illustrated, a high viscosity fluid such as oil, will utilize nearly the entire cross section of the parallel path conduit along the entire length of branch 334, allowing the fluid to flow at a relative high flowrate. The viscosity dominant flow path provides a low resistance flow path that minimizes losses such that production of the selected fluid is maximized. When the fluid flowing through valve element 330 has a viscosity less than the second predetermined level, the fluid follows the inertia dominant flow path as indicated by streamlines 344 moving from left to right in FIG. 17C. As illustrated, a low viscosity fluid such as water, fails to utilize significant portions of the cross section of the parallel path conduit such as at locations 346*a*, 346*b*, 346*c*. The inertia dominant flow path is a high resistance and/or self-choking flow path creating large losses and a significantly reduced flowrate such that production of the non-selected fluid is minimized.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. For example, numerous combinations of the features disclosed herein will be apparent to persons skilled in the art including the combining of features described in different and diverse embodiments, implementations, contexts, applications and/or figures. Other substitutions, modifications, changes and omissions may be made in the design, operating conditions and arrangement of the embodiments without departing from the scope of the present disclosure. Such modifications and combinations of the illustrative embodiments as well as other embodiments will be apparent to persons skilled in the art upon reference to the description. It is, therefore, intended that the appended claims encompass any such modifications or embodiments.

What is claimed is:

1. An autonomous flow control device for regulating a production rate of a fluid having a viscosity, the autonomous flow control device comprising:

a valve assembly having at least one fluid inlet and at least one fluid outlet; and a valve element disposed between the at least one fluid inlet and the at least one fluid outlet, the valve element having a viscosity dominant flow path configured to provide a first flow resistance and an inertia dominant flow path configured to provide a second flow resistance that is greater than the first flow resistance;

wherein, when the viscosity of the fluid is greater than a first predetermined level, the fluid follows the viscosity dominant flow path with the first flow resistance;

wherein, when the viscosity of the fluid is less than a second predetermined level, the fluid follows the inertia dominant flow path with the second flow resistance, thereby regulating the production rate of the fluid responsive to changes in the viscosity of the fluid; and wherein, the viscosity dominant flow path has a larger effective flow area than the inertia dominant flow path.

2. The autonomous flow control device as recited in claim 1 wherein, when the fluid is oil, the fluid follows the viscosity dominant flow path with the first flow resistance.

3. The autonomous flow control device as recited in claim 1 wherein, when the fluid is water, the fluid follows the inertia dominant flow path with the second flow resistance.

4. The autonomous flow control device as recited in claim 1 wherein, when the fluid is natural gas, the fluid follows the inertia dominant flow path with the second flow resistance.

5. The autonomous flow control device as recited in claim 1 wherein, when the fluid is a multiphase fluid containing an oil component and a water component, the fluid follows the viscosity dominant flow path with the first flow resistance if the fluid has at least a predetermined portion of the oil component and the fluid follows the inertia dominant flow path with the second flow resistance if the fluid has at least a predetermined portion of the water component.

6. The autonomous flow control device as recited in claim 1 wherein, when the fluid is a multiphase fluid containing an oil component and a natural gas component, the fluid follows the viscosity dominant flow path with the first flow resistance if the fluid has at least a predetermined portion of the oil component and the fluid follows the inertia dominant flow path with the second flow resistance if the fluid has at least a predetermined portion of the natural gas component.

7. The autonomous flow control device as recited in claim 1 wherein, when the fluid is a multiphase fluid, the valve element is configured to interpret the viscosity of the fluid as an effective viscosity of a single phase fluid.

8. The autonomous flow control device as recited in claim 1 wherein the first predetermined level is between 1 centipoise and 10 centipoises; and wherein the second predetermined level is between 0.1 centipoises and 1 centipoise.

9. The autonomous flow control device as recited in claim 1 wherein the first predetermined level has a ratio to the second predetermined level of between 2 to 1 and 10 to 1.

10. The autonomous flow control device as recited in claim 1 wherein the valve element further comprises a multistage valve element.

11. The autonomous flow control device as recited in claim 1 wherein the valve element further comprises a multistage self-impinging valve element.

12. The autonomous flow control device as recited in claim 1 wherein the valve element further comprises a multistage sinuous valve element.

13. The autonomous flow control device as recited in claim 1 wherein the valve element further comprises a multistage waveform valve element.

14. The autonomous flow control device as recited in claim 1 wherein the valve element further comprises a multistage valve element with each stage including parallel paths.

15. The autonomous flow control device as recited in claim 1 wherein the viscosity dominant flow path is a higher flowrate path than the inertia dominant flow path.

16. A flow control screen for regulating a production rate of a fluid having a viscosity, the flow control screen comprising:

a base pipe with an internal passageway and at least one base pipe inlet;

a filter medium positioned around the base pipe; and at least one autonomous flow control device coupled to the base pipe, each autonomous flow control device comprising:

a valve assembly having at least one fluid inlet and at least one fluid outlet, the at least one fluid outlet in fluid communication with the at least one base pipe inlet; and a valve element disposed between the at least one fluid inlet and the at least one fluid outlet, the valve element having a viscosity dominant flow path configured to provide a first flow resistance and an inertia dominant flow path configured to provide a second flow resistance that is greater than the first flow resistance;

wherein, when the viscosity of the fluid is greater than a first predetermined level, the fluid follows the viscosity dominant flow path with the first flow resistance;

wherein, when the viscosity of the fluid is less than a second predetermined level, the fluid follows the inertia dominant flow path with the second flow resistance, thereby regulating the production rate of the fluid responsive to changes in the viscosity of the fluid; and wherein, the viscosity dominant flow path has a larger effective flow area than the inertia dominant flow path.

17. The flow control screen as recited in claim 16 wherein, for each autonomous flow control device, when the fluid is oil, the fluid follows the viscosity dominant flow path with the first flow resistance and when the fluid is water, the fluid follows the inertia dominant flow path with the second flow resistance.

18. A completion string for regulating a production rate of a fluid having a viscosity, the completion string comprising:

a plurality of flow control screens each having a base pipe with an internal passageway and at least one base pipe inlet, a filter medium positioned around the base pipe and at least one autonomous flow control device coupled to the base pipe, each autonomous flow control device comprising:

a valve assembly having at least one fluid inlet and at least one fluid outlet, the at least one fluid outlet in fluid communication with the respective base pipe inlet; and a valve element disposed between the at least one fluid inlet and the at least one fluid outlet, the valve element having a viscosity dominant flow path configured to provide a first flow resistance and an inertia dominant flow path configured to provide a second flow resistance that is greater than the first flow resistance;

wherein, when the viscosity of the fluid is greater than a first predetermined level, the fluid follows the viscosity dominant flow path with the first flow resistance;

wherein, when the viscosity of the fluid is less than a second predetermined level, the fluid follows the inertia dominant flow path with the second flow resistance, thereby regulating the production rate of the fluid responsive to changes in the viscosity of the fluid; and wherein, the viscosity dominant flow path has a larger effective flow area than the inertia dominant flow path.

* * * * *